US009002244B2

(12) United States Patent
Ozaki et al.

(10) Patent No.: US 9,002,244 B2
(45) Date of Patent: Apr. 7, 2015

(54) IMAGE FORMING APPARATUS INCLUDING DEVELOPING DEVICE USING TONER HOLDING MEMBER WITH SPECIFIC SURFACE ROUGHNESS

(71) Applicant: Fuji Xerox Co., Ltd., Minato-ku, Tokyo (JP)

(72) Inventors: Yoshifumi Ozaki, Kanagawa (JP); Shinji Mitsui, Kanagawa (JP); Akihiko Noda, Kanagawa (JP); Masahiro Andoh, Kanagawa (JP); Hisashi Murase, Kanagawa (JP); Takafumi Wakai, Kanagawa (JP); Munenobu Okubo, Kanagawa (JP); Masaru Sakuma, Kanagawa (JP); Yasuyuki Tsutsumi, Kanagawa (JP); Hirokazu Hamano, Kanagawa (JP); Kazuaki Iikura, Kanagawa (JP); Yosuke Ninomiya, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 150 days.

(21) Appl. No.: 13/745,104

(22) Filed: Jan. 18, 2013

(65) Prior Publication Data

US 2014/0056623 A1 Feb. 27, 2014

(30) Foreign Application Priority Data

Aug. 27, 2012 (JP) ..... 2012-186621

(51) Int. Cl.

*G03G 15/08* (2006.01)
*G03G 13/08* (2006.01)
*G03G 15/06* (2006.01)

(52) U.S. Cl.

CPC ..... *G03G 15/0806* (2013.01); *G03G 13/08* (2013.01); *G03G 15/065* (2013.01); *G03G 15/0818* (2013.01)

(58) Field of Classification Search

CPC ..... G03G 15/0818; G03G 2215/0634; G03G 2215/0636; G03G 2215/0861
USPC ..... 399/270, 285, 279, 286; 430/103, 120.1
See application file for complete search history.

(56) References Cited

U.S. PATENT DOCUMENTS 6,912,956 B2 * 7/2005 Mori ..... 101/459
7,289,756 B2 * 10/2007 Hasegawa et al. ..... 399/274
7,650,104 B2 * 1/2010 Baba et al. ..... 399/274

(Continued)

FOREIGN PATENT DOCUMENTS

JP 03217877 A * 9/1991
JP 09230623 A * 9/1997

(Continued)

*Primary Examiner* — Robert Beatty
(74) *Attorney, Agent, or Firm* — Sughrue Mion, PLLC

(57) ABSTRACT

A developing device including a toner holding member that faces but is not in contact with an image carrier carrying a latent image and that rotates while holding a nonmagnetic toner, a charging member that charges the toner, and a developing electric field forming unit that forms a developing electric field at least including a direct current component to cause the charged toner to fly and adhere to the latent image to develop the latent image. When the developing electric field is applied such that the toner is caused to fly toward the image carrier by the direct current component of the developing electric field, maintaining a non-electrostatic adhesion of the toner to the toner holding member to be about 2 nN or more under a low-temperature low-humidity environment of a temperature of 10° C. and a relative humidity of 15%. The toner holding member's surface has a specific surface roughness specified by a specific oil retention volume.

20 Claims, 30 Drawing Sheets

(56) References Cited

U.S. PATENT DOCUMENTS

| | | | | |
|---|---|---|---|---|
| 7,995,943 | B2 * | 8/2011 | Kouno et al. | 399/55 |
| 8,055,166 | B2 * | 11/2011 | Mestha et al. | 399/266 |
| 8,244,145 | B2 * | 8/2012 | Yamaguchi et al. | 399/31 |
| 2007/0092749 | A1 * | 4/2007 | Heuberger et al. | 428/553 |
| 2008/0317514 | A1 * | 12/2008 | Fujishima | 399/286 |
| 2010/0143007 | A1 * | 6/2010 | Eun et al. | 399/286 |

FOREIGN PATENT DOCUMENTS

| | | | | |
|---|---|---|---|---|
| JP | 2003-330264 | A | | 11/2003 |
| JP | 2004-157458 | A | | 6/2004 |
| JP | 2006259286 | A | * | 9/2006 |
| JP | 2007-033667 | A | | 2/2007 |
| JP | 2007-256942 | A | | 10/2007 |

* cited by examiner $$V0 = \frac{(100 - Mr2) \times Rvk}{2000} \ (\mu m)$$

$$tp = \frac{\eta p}{L} \times 100$$

$\eta p$: b1+b2+· · · · +bn

L: SAMPLING LENGTH

TONER ADHESION $F = \underbrace{A(Q/d)^2}_{\text{ELECTROSTATIC ADHESION}} + \underbrace{Bd}_{\text{NON-ELECTROSTATIC ADHESION}}$

FIG. 16

MEASUREMENT SYSTEM: SURFCOM 1400D
(MANUFACTURED BY TOKYO SEIMITSU CO., LTD.)

MEASUREMENT CONDITIONS

| | |
|---|---|
| PICKUP | E-DT-S03A |
| DETECTOR | 2 μmR (60° CONICAL DIAMOND) |
| CALCULATION STANDARD | JIS-'01 |
| MEASUREMENT TYPE | ROUGHNESS MEASUREMENT |
| MEASUREMENT LENGTH | 4.0 mm |
| CUTOFF WAVELENGTH | 0.8 mm |
| MEASUREMENT MAGNIFICATION | ×2 K |
| MEASUREMENT SPEED | 0.30 mm/s |
| CUTOFF TYPE | GAUSSIAN |
| SLOPE CORRECTION | LEAST SQUARE LINEAR CORRECTION |
| COMPLEMENTARY OPERATION LENGTH | CUTOFF WAVELENGTH/3× |
| λs CUTOFF RATIO | 300 |
| λs CUTOFF WAVELENGTH | 2.6667 μm |
| EVALUATION LENGTH | 4.0 mm |

MEASUREMENT EXAMPLE

| | | |
|---|---|---|
| Ra | 1.4233 | μm |
| Ramax | 1.7439 | μm |
| Ramin | 1.2257 | μm |
| Rz | 9.9584 | μm |
| RSm | 132.8261 | μm |
| RΔa | 0.1068 | |
| Rλa | 83.9499 | μm |
| Ir | 101.21% | |
| Pc | 44 | |
| Rsk | 1.1446 | |
| Rku | 4.2253 | |
| Rk | 3.0705 | μm |
| Rpk | 3.2813 | μm |
| Rvk | 1.1613 | μm |
| Mr1 | 23.99% | |
| Mr2 | 93.99% | |
| V0 | 0.0035 | |
| K | 0.3782 | |

FIG. 18A

| | SURFACE POTENTIAL OF COUNTER ELECTRODE (PHOTOCONDUCTOR) Vpc (V) | VOLTAGE APPLIED TO DEVELOPMENT ROLLER Vdc (V) | DEVELOPMENT POTENTIAL DIFFERENCE Vdev (V) | DMA M (g/m²) | MEASUREMENT OF Q AND d OF TONER HAVING FLOWN TO COUNTER ELECTRODE |
|---|---|---|---|---|---|
| DEVELOPMENT CONDITIONS | −202 | −193 | −9 | 0.05 | |
| | −202 | −594 | 392 | 0.05 | |
| | −202 | −693 | 491 | 0.1 | |
| | −202 | −794 | 592 | 0.15 | |
| | −202 | −894 | 692 | 0.15 | PERFORMED |
| | −202 | −994 | 792 | 0.35 | PERFORMED |
| | −202 | −1095 | 893 | 0.4 | |
| | −202 | −1195 | 993 | 0.7 | |
| | −202 | −1294 | 1092 | 0.85 | |
| | −202 | −1394 | 1192 | 1.45 | |
| | −202 | −1495 | 1293 | 1.85 | PERFORMED |
| | −202 | −1595 | 1393 | 2.2 | |
| | −202 | −1695 | 1493 | 2.5 | |
| | −202 | −1796 | 1594 | 2.85 | |
| | −202 | −1896 | 1694 | 3.4 | PERFORMED |
| | −202 | −1995 | 1793 | 2.7 | |

FIG. 18B

| | SURFACE POTENTIAL OF COUNTER ELECTRODE (PHOTOCONDUCTOR) Vpc (V) | VOLTAGE APPLIED TO DEVELOPMENT ROLLER Vdc (V) | DEVELOPMENT POTENTIAL DIFFERENCE Vdev (V) | Q OF TONER PARTICLES HAVING FLOWN TO COUNTER ELECTRODE (fC) | PARTICLE DIAMETER d OF TONER PARTICLES HAVING FLOWN TO COUNTER ELECTRODE (μm) | DRS (mm) | TOTAL ADHESION (TONER ADHESION nN) OF TONER PARTICLES HAVING FLOWN TO COUNTER ELECTRODE DUE TO DEVELOPING ELECTRIC FIELD |
|---|---|---|---|---|---|---|---|
| DEVELOPMENT CONDITIONS | −202 | −894 | 692 | −1.40177879 | 5.978206864 | 0.189 | −5 |
| | −202 | −994 | 792 | −1.34115652 | 5.849833407 | 0.189 | −6 |
| | −202 | −1495 | 1293 | −0.93424223 | 5.398623956 | 0.189 | −6 |
| | −202 | −1896 | 1694 | −0.60985398 | 5.15084504 | 0.189 | −5 |

FIG. 18C

| FLYING START Vdev | TONER FLYING START Q | TONER FLYING START d | DRS (mm) | TONER ADHESION (nN) |
|---|---|---|---|---|
| 804.89 | −1.32 | 5.85 | 0.189 | −5.6 |

FIG. 21

| TONER | AGED TONER DUE TO IDLING CORRESPONDING TO 15 kPV | |
|---|---|---|
| CHARGING BLADE | AGED BLADE OF PHOSPHOR BRONZE | NEW BLADE OF PHOSPHOR BRONZE |
| TONER ADHESION [nN] | −5.63 | −7.81 |
| FLYING START Vdev [V] | 804.89 | 861.58 |
| TONER FLYING START CHARGE AMOUNT Q [fC] | −1.32 | −1.71 |
| TONER FLYING START PARTICLE DIAMETER d [μm] | 5.85 | 5.50 |
| F [N] | $-5.62698\times10^{-9}$ | $-7.81328\times10^{-9}$ |
| Q [C] | $-1.3213\times10^{-15}$ | $-1.71396\times10^{-15}$ |
| d [m] | $5.85258\times10^{-6}$ | $5.49986\times10^{-6}$ |
| $ax+by=c$<br>$a'x+b'y=c'$ | $A(Q/d)^2+Bd=F$ | |
| A [(kg m$^3$)/(C$^2$ s$^2$)] | 51309120492 | |
| B [kg/s$^2$] | 0.000514611 | |
| COULOMB FORCE [nN] | 2.62 | 4.98 |
| NON-ELECTROSTATIC ADHESION [nN] | 3.01 | 2.83 |
| TOTAL ADHESION [nN] | 5.63 | 7.81 |

$$F(1)=A\cdot\left(\frac{Q1}{d1}\right)^2+B\cdot d1$$

$$F(2)=A\cdot\left(\frac{Q2}{d2}\right)^2+B\cdot d2$$

| | AGED BLADE | NEW BLADE |
|---|---|---|
| NON-ELECTROSTATIC ADHESION [nN] | 3.011801855 | 2.830289162 |
| COULOMB FORCE [nN] | 2.615178558 | 4.982990007 |

FIG. 30

| DEVELOPMENT ROLLER | COULOMB FORCE (nN) | NON-ELECTROSTATIC ADHESION (nN) | TONER ADHESION (nN) | TONER FLYING START PARTICLE DIAMETER (μm) |
|---|---|---|---|---|
| Al BLASTED (#120) | 6.6 | 1.4 | 8.0 | 5.74 |
| | 3.6 | 1.3 | 4.9 | 5.34 |
| Al BLASTED (#320) | 6.1 | 1.6 | 7.8 | 5.86 |
| | 2.7 | 1.5 | 4.2 | 5.42 |
| Al BLASTED (#120) AND SUBSEQUENTLY ETCHED | 5.6 | 2.6 | 8.2 | 5.95 |
| | 1.9 | 2.4 | 4.3 | 5.60 |
| DIAMOND COATED | 1.8 | 1.5 | 3.3 | 5.81 |
| | 1.4 | 1.4 | 2.8 | 5.51 |
| STYRENE ACRYLIC COATED/RUBBER ROLLER (AGED) | 2.6 | 3.0 | 5.6 | 5.85 |
| | 5.0 | 2.8 | 7.8 | 5.50 |
| URETHANE COATED/RUBBER ROLLER 1 | 6.9 | 2.3 | 9.2 | 6.13 |
| | 1.4 | 2.1 | 3.5 | 5.46 |
| PHENOLIC COATED | 4.0 | 1.3 | 5.3 | 5.80 |
| | 2.2 | 1.2 | 3.4 | 5.36 |
| URETHANE COATED | 5.8 | 3.0 | 8.8 | 5.76 |
| | 1.6 | 2.8 | 4.4 | 5.38 |
| URETHANE COATED/RUBBER ROLLER 2 | 5.0 | 3.8 | 8.8 | 5.96 |
| | 2.8 | 3.5 | 6.2 | 5.53 |
| NYLON COATED | 7.5 | 2.2 | 9.7 | 5.89 |
| | 2.2 | 2.0 | 4.2 | 5.38 |
| ALUMILITE, SEALED WITH FLUOROCARBON RESIN | 4.2 | 2.2 | 6.5 | 6.10 |
| | 1.3 | 2.1 | 3.4 | 5.63 |

IMAGE FORMING APPARATUS INCLUDING DEVELOPING DEVICE USING TONER HOLDING MEMBER WITH SPECIFIC SURFACE ROUGHNESS

CROSS-REFERENCE TO RELATED APPLICATIONS

This application is based on and claims priority under 35 USC 119 from Japanese Patent Application No. 2012-186621 filed Aug. 27, 2012.

BACKGROUND

1. Technical Field

The present invention relates to a development method, a developing device, and an image forming assembly and an image forming apparatus that include the developing device.

2. Summary

According to an aspect of the invention, there is provided a development method used for a developing device including a toner holding member that faces but is not in contact with an image carrier carrying a latent image and that rotates while holding a nonmagnetic toner, a charging member that charges the toner held by the toner holding member, and a developing electric field forming unit that forms a developing electric field at least including a direct current component having a predetermined potential difference between the image carrier and the toner holding member to cause the charged toner to fly and adhere to the latent image on the image carrier to develop the latent image, the method including, when the developing electric field formed by the developing electric field forming unit is applied such that the toner held by the toner holding member is caused to fly toward the image carrier by the direct current component of the developing electric field alone, maintaining a non-electrostatic adhesion of the toner to the toner holding member to be about 2 nN or more under a low-temperature low-humidity environment of a temperature of 10° C. and a relative humidity of 15%.

BRIEF DESCRIPTION OF THE DRAWINGS

Exemplary embodiments of the present invention will be described in detail based on the following figures, wherein:

FIG. 16 is an explanatory view summarizing a measurement system, measurement conditions, and a measurement example in the measurement of various surface roughness parameters of a development roller;

FIG. 18A describes developed mass data in evaluation of adhesion to a development roller in a developing device in Example 2 in which the voltage applied to the development roller is varied;

FIG. 18B describes data including charge amount Q and particle diameter d of toner particles having flown in terms of representative data points in FIG. 18A;

FIG. 18C describes data including flying start development voltage Vdev, flying start toner charge amount Q and particle diameter d;

FIG. 21 is an explanatory view illustrating an example of a sheet for calculating adhesion in a developing device in Example 2;

FIG. 30 is an explanatory view describing relationships of Coulomb force, non-electrostatic adhesion, toner adhesion, and toner flying start particle diameter in the cases where different development rollers are used in a developing device in Example 5 and Comparative example 5;

DETAILED DESCRIPTION

Overview of Exemplary Embodiment

Figure 1A:
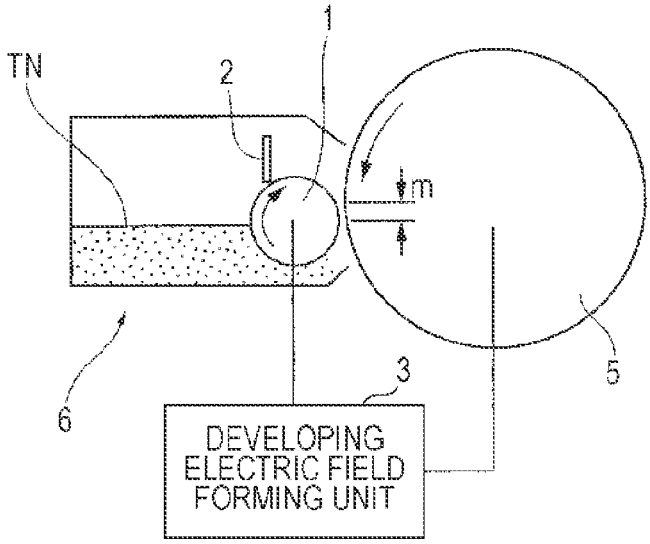
FIG. 1A is an explanatory view schematically illustrating an image forming apparatus including a developing device according to an exemplary embodiment of the invention.

FIG. 1A schematically illustrates an image forming apparatus including a developing device according to an exemplary embodiment of the invention.

In FIG. 1A, the image forming apparatus includes an image carrier 5 that carries a latent image and a developing device 6 that develops the latent image carried by the image carrier 5 with a nonmagnetic toner.

In this exemplary embodiment, the image carrier 5, which carries a latent image, is not limited to a photoconductor or a dielectric. The image carrier 5 may be a member in which pixel electrodes are arranged in a grid pattern in accordance with a pixel density and a latent-image voltage for forming a latent image is applied to the pixel electrodes. The image carrier 5 and the developing device 6 may be individually disposed. Alternatively, for example, the image carrier 5 and the developing device 6 may be incorporated into an image forming assembly that is detachably mountable to a receiving portion provided in the housing of the image forming apparatus.

Figure 1B:
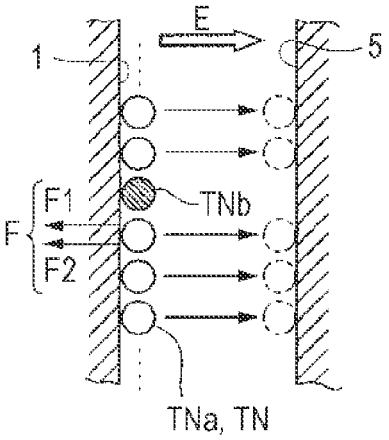
FIG. 1B is an explanatory view illustrating a development method used for the developing device in FIG. 1A.

In this exemplary embodiment, as illustrated in FIGS. 1A and 1B, the developing device 6 includes a toner holding member 1 that faces but is not in contact with the image carrier 5 carrying a latent image and that rotates while holding a nonmagnetic toner TN; a charging member 2 that charges the toner TN held by the toner holding member 1; and a developing electric field forming unit 3 that forms a developing electric field E at least including a direct current component having a predetermined potential difference between the image carrier 5 and the toner holding member 1 to cause the toner TN (held by the toner holding member 1 and having been charged by the charging member 2) to fly and adhere to the latent image on the image carrier 5 to develop the latent image.

In this technical configuration, the toner holding member 1, which holds the nonmagnetic toner TN, is not particularly limited and may be appropriately selected. A non-limiting representative form of the toner holding member 1 is a roller.

The charging member 2, which is a functional member that charges the toner TN held by the toner holding member 1, may be appropriately selected: for example, a member that comes into contact with the toner to frictionally charge the toner.

The developing electric field forming unit 3, which forms a developing electric field E at least including a direct current component, may form a developing electric field in which an alternating current component is superimposed on a direct current component to enhance the developability.

The developing electric field E formed by the developing electric field forming unit 3 has such a low intensity that a properly charged toner TNa is caused to fly to the image carrier 5. Thus, the intensity of the developing electric field E is not decreased.

A development method employed in the exemplary embodiment uses the above-described developing device 6. As illustrated in FIG. 1B, when the developing electric field E formed by the developing electric field forming unit 3 is applied such that the toner TN held by the toner holding member 1 is caused to fly toward the image carrier 5 by the direct current component of the developing electric field alone, a non-electrostatic adhesion F2 of the toner TN to the toner holding member 1 is maintained to be 2 nN or more or about 2 nN or more under a low-temperature low-humidity environment of a temperature of 10° C. and a relative humidity of 15%.

In general, the toner TN is frictionally charged with the charging member 2. When the toner TN is repeatedly used under friction with the charging member 2, it gradually alters over time.

In this case, for example, where the toner TN contains an external additive having a diameter of 30 nm or more, after the toner TN alters over time, the external additive is partially embedded in the particle surfaces of the toner. Thus, the fluidity of the toner TN is degraded. In addition, the contact area between the toner TN and the charging member 2 is decreased and hence the chargeability of the toner TN tends to be degraded.

In this state, the toner TN is not properly charged and a lowly charged toner or a reversed polarity toner tends to be generated. When such an improperly charged toner TNb is present in a development region m under the developing electric field E of the toner holding member 1, the improperly charged toner TNb may be caused to fly to a non-image portion (for example, background) in the image carrier 5 and adhere as stains to the non-image portion, which is commonly called the fogging phenomenon.

In order to avoid undesired flying of the improperly charged toner TNb toward the image carrier 5, in the exemplary embodiment, the non-electrostatic adhesion F2 of the toner TN to the toner holding member 1 is maintained to be 2 nN or more or about 2 nN or more under the predetermined environmental conditions. The predetermined environmental conditions are defined because the non-electrostatic adhesion F2 of the toner TN depends on environmental conditions and hence the environmental conditions under which the non-electrostatic adhesion F2 is measured are specified. The non-electrostatic adhesion F2 is measured with, for example, an E-spart (particle charge amount distribution measurement system) manufactured by Hosokawa Micron Corporation.

In the above-described development method, in the developing electric field E, an alternating current component having a periodically varying potential may be superimposed on the direct current component.

Compared with a developing electric field E composed of a direct current component alone, use of a developing electric field E in which an alternating current component is superimposed on a direct current component enhances developability; however, the toner TN in the development region m is activated and hence the fogging amount due to the improperly charged toner TNb on the image carrier 5 tends to increase.

The mechanism of the fogging phenomenon will be specifically described. The direct current component of the developing electric field E causes the properly charged toner TNa in the development region m to fly from the toner holding member 1 and the alternating current component of the developing electric field E subsequently causes the properly charged toner TNa to move back and forth. This toner TN that is moving back and forth knocks other toners TN off the toner holding member 1 or flies while taking neighboring toners TN along therewith. As a result, the improperly charged toner TNb such as a lowly charged toner that is originally difficult to fly by the electrostatic force of the developing electric field E flies in the development region m and reaches and adheres to the image carrier 5. Thus, the fogging phenomenon is caused.

In summary, the fogging phenomenon is caused by the following three factors: (1) the improperly charged toner TNb such as a lowly charged toner or a reversed polarity toner is present on the toner holding member 1; (2) the properly charged toner TNa that knocks other toners off or that flies while taking neighboring toners along therewith, is excessively caused to fly in the development region m; and (3) the lowly charged toner or the reversed polarity toner on the toner holding member 1 is knocked off.

That is, there is the following relationship: fogging ∝ amount of lowly charged toner×knocking off efficiency/adhesion of lowly charged toner.

In this relationship, the "amount of lowly charged toner" is obtained by a charge amount distribution measurement for toners on the toner holding member 1. The "knocking off efficiency" is an index depending on the generation amount of toners that knock the toner holding member 1, the number that the toners knock the toner holding member 1, and the kinetic energy of the toners. The "adhesion of lowly charged toner" is mostly composed of non-electrostatic adhesion; when the energy of the toner knocking the lowly charged toner exceeds its adhesion energy composed of non-electrostatic adhesion, the lowly charged toner is knocked off. In general, adhesion F is the sum of electrostatic adhesion (Coulomb force) F1 and non-electrostatic adhesion F2. However, in lowly charged toners, the non-electrostatic adhesion F2 is dominant. In the exemplary embodiment, since the non-electrostatic adhesion F2 is maintained to be the predetermined value or more, the fogging factors (2) and (3) are less likely to be satisfied and hence the fogging phenomenon is suppressed.

In existing examples, when the amount of lowly charged toners increases, fogging due to the lowly charged toners is seriously caused; in order to address such a problem, attempts mostly aiming to maintain the toner charge amount distribution have been made.

A representative example of the toner TN is a toner that at least contains a binder resin, a colorant, and an external additive having a particle diameter of 30 nm or more; and, after the toner is used over time, the external additive is partially embedded in the particle surfaces of the toner.

When the toner TN containing an external additive having a particle diameter of 30 nm or more is used over time, the external additive is often partially embedded in the toner particle surfaces. When the toner TN has thus altered over time, the fluidity of the toner TN is degraded or the toner particle surfaces do not sufficiently come into contact with the charging member 2. As a result, cases where the toner TN is not properly charged often occur. In contrast, in the exemplary embodiment, since the non-electrostatic adhesion F2 of the toner TN to the toner holding member 1 is maintained to be 2 nN or more or about 2 nN or more under the predetermined environmental conditions, the properly charged toner TNa is not excessively caused to fly. As a result, flying of the improperly charged toner TNb to the image carrier 5 due to taking along or knocking off caused by the properly charged flying toner TNa is effectively suppressed.

Another representative example of the toner TN is a toner that at least contains a binder resin, a colorant, and an external additive composed of only particles having a diameter of less than 30 nm; and, after the toner is used over time, the external additive is substantially embedded in the particle surfaces of the toner.

In the toner TN containing an external additive composed of only particles having a diameter of less than 30 nm, at the initial stage of usage, the external additive having a small particle diameter is substantially uniformly distributed over the entire toner particle surfaces; while the toner TN is used over time, the external additive having a small particle diameter is separated from the toner particle surfaces or is gradually embedded in the toner particle surfaces, that is, the external additive having a small particle diameter is substantially embedded in the toner particle surfaces. In summary, when the toner TN is initially used, the external additive having a small particle diameter is substantially uniformly distributed over the entire toner particle surfaces; while the toner TN is used over time, the external additive is maintained to be substantially embedded in the toner particle surfaces. The toner TN at the initial stage of usage tends to be sufficiently charged by the charging member 2; even when the improperly charged toner TNb is generated, since the non-electrostatic adhesion F2 of the toner TN to the toner holding member 1 is maintained to be 2 nN or more or about 2 nN or more under the predetermined environmental conditions, as described above, flying of the improperly charged toner TNb to the image carrier 5 due to taking along or knocking off caused by the properly charged toner TNa is effectively suppressed.

In order to embody the development method in the form of the developing device 6, for example, the surface roughness of the toner holding member 1 may be properly adjusted.

Figure 1C:
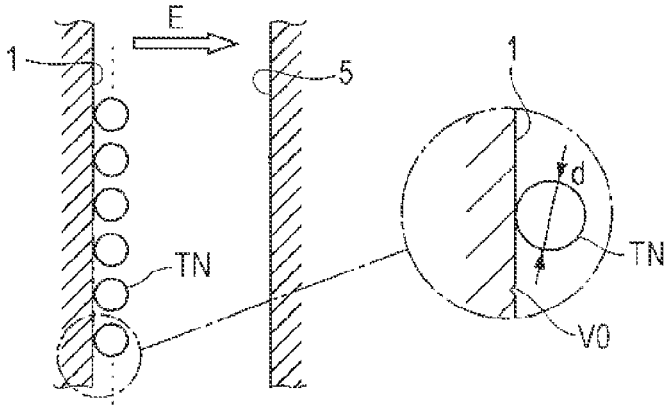
FIG. 1C is an explanatory view illustrating a portion of the developing device.

Specifically, as illustrated in FIG. 1C, the developing device 6 includes a toner holding member 1 that faces but is not in contact with an image carrier 5 carrying a latent image and that rotates while holding a nonmagnetic toner TN; a charging member 2 that charges the toner TN held by the toner holding member 1; and a developing electric field forming unit 3 that forms a developing electric field E at least including a direct current component having a predetermined potential difference between the image carrier 5 and the toner holding member 1 to cause the toner TN (held by the toner holding member 1 and having been charged by the charging member 2) to fly and adhere to the latent image on the image carrier 5 to develop the latent image, wherein $V0/d<6.8\times10^{-4}$ is satisfied where d (μm) represents an average particle diameter of the nonmagnetic toner TN and, regarding surface roughness of the toner holding member 1, V0 represents an oil retention volume corresponding to a volume of oil retained for an oil retention depth Rvk relative to a surface area of 1 $cm^2$.

In the exemplary embodiment, in order to easily realize the idea of maintaining the non-electrostatic adhesion F2 of the improperly charged toner TNb to be 2 nN or more or about 2 nN or more, attention has been focused on strong correlations between the non-electrostatic adhesion F2 and indices relating to smoothness of the surface roughness of the toner holding member 1 and, among the indices relating to smoothness, the oil retention volume V0 has been selected.

Studies on a correlation between the non-electrostatic adhesion F2 and the surface roughness of the toner holding member 1 have revealed, as surface roughness parameters having strong correlations with the non-electrostatic adhesion F2, indices relating to smoothness (mean slope RΔa, developed length ratio Rlr, oil retention depth Rvk, and oil retention volume V0). In the exemplary embodiment, since the oil retention volume V0 has a very strong correlation with the non-electrostatic adhesion F2, it is used to define a desired smoothness range of the toner holding member 1. Among surface roughness indices of the toner holding member 1, it has been confirmed that the non-electrostatic adhesion F2 does not have strong correlations with indices relating to the height direction, indices relating to lubricity, or indices relating to the lateral direction. The relationship between the non-electrostatic adhesion F2 and the surface roughness of the toner holding member 1 will be described in detail in Example 1 below.

The correlation between the non-electrostatic adhesion F2 and the surface roughness of the toner holding member 1 is evaluated on the basis of measurement results obtained with a SURFCOM 1400D (manufactured by TOKYO SEIMITSU CO., LTD.) as described in Example 1 below.

The oil retention volume V0 of the toner holding member 1 probably depends on the particle diameter d of the toner TN. Specifically, even when the oil retention volume V0 is the same, the relative relationship between the surface roughness of the toner holding member 1 and the toner TN varies depending on whether the toner TN has a large particle diameter or a small particle diameter. On the other hand, even in the cases where the oil retention volumes V0 are different, when the ratios of oil retention volume V0 to toner average particle diameter d are the same, the relative relationships between the surface roughness of the toner holding member 1 and the toner TN are probably the same. Therefore, the relative parameter V0/d has been defined.

Regarding the coefficient "$6.8\times10^{-4}$", when the threshold value of the oil retention volume V0 is 0.004, the average particle diameter d of the toner TN caused to fly is 5.85 μm; accordingly, $0.004/5.85=6.837\ldots\times10^{-4}$, which is a threshold value, is determined. Thus, the coefficient "$6.8\times10^{-4}$" has been selected. This is described in detail in Examples 2 and 4 below.

Hereinafter, optional configurations of the developing device 6 according to the exemplary embodiment will be described.

The developing electric field forming unit 3 may form a developing electric field E in which an alternating current component having a periodically varying potential is superimposed on the direct current component.

Compared with a developing electric field E composed of a direct current component alone, use of a developing electric field E in which an alternating current component is superimposed on a direct current component enhances developability; however, the toner TN in the development region m is activated and hence the fogging amount due to the improperly charged toner TNb on the image carrier 5 tends to increase.

However, in the exemplary embodiment, by adjusting the oil retention volume V0, the surface smoothness of the toner holding member 1 is maintained to be in a desired state. Thus, the non-electrostatic adhesion F2 of the toner TN to the toner holding member 1 is increased and excessive flying of the properly charged toner TNa is suppressed. In addition, flying of the improperly charged toner TNb to the image carrier 5 due to taking along or knocking off caused by the properly charged flying toner TNa is suppressed.

The toner holding member 1 may be a member formed by covering the surface of a metal base member with a resin cover layer; the charging member 2 may be a metal plate member that is in contact with the surface of the toner holding member 1.

In this example, the toner holding member 1 and the charging member 2 may be prepared at a low cost with a metal base member and a metal plate member.

In the developing device 6 according to the exemplary embodiment, the toner TN may have an average particle diameter of 6.5 μm or less.

In a toner TN having an average particle diameter of more than 6.5 μm, regarding the contribution ratio, to the adhesion F, between the electrostatic adhesion (Coulomb force) F1 and the non-electrostatic adhesion F2 such as Van der Waals force, the electrostatic adhesion F1 is dominant. In contrast, in the case of a small average particle diameter of 6.5 μm or less, the proportion of the electrostatic adhesion F1 decreases and hence the influence of the non-electrostatic adhesion F2 tends to become prominent.

In the developing device 6 according to the exemplary embodiment, among small-particle-diameter toners, a low-temperature fixing toner TN that is fixed at a very low fixing temperature (for example, about 120° C. to about 140° C.) may be used.

The low-temperature fixing toner TN may be appropriately selected. For example, a low-molecular-weight resin may be used as a toner material, Tg (glass transition temperature) of a resin may be decreased, or a crystalline resin may be used.

The low-temperature fixing toner TN may be specified by indicating that it is usable at the above-described low fixing temperature. The low-temperature fixing toner TN may be specified by, in addition to direct indication of the usable fixing temperature, regarding a characteristic parameter of the toner TN relating to the low-temperature fixability, indicating a value of the characteristic parameter. This characteristic parameter of the toner TN may be, for example, loss elastic modulus G" representing the viscosity component of the toner, which is a viscoelastic substance.

Such a low-temperature fixing toner TN has a viscosity characteristic in which partial embedding of the external additive in the toner particle surfaces is promoted by a mechanical stress. When the external additive is thus partially embedded in the toner particle surfaces, fluidity or chargeability of the toner TN is adversely affected and the charge amount distribution of the toner TN is broadened (the charge amount distribution width is broadened). Thus, a lowly charged toner or a reversed polarity toner tends to be generated. Accordingly, such an improperly charged toner TNb tends to be transferred to a non-image portion (for example, background) in the image carrier 5, that is, fogging tends to be caused. In such a state, in the exemplary embodiment, the non-electrostatic adhesion F2 of the low-temperature fixing toner TN to the toner holding member 1 is maintained to be the predetermined value or more and, as a result, flying of the improperly charged toner TNb to the image carrier 5 due to taking along or knocking off caused by the properly charged flying toner TNa is suppressed.

Such a low-temperature fixing toner TN may contain, as a main component, a polyester resin serving as a binder resin.

In this case, the glass transition temperature Tg of the polyester resin may be 40° C. or more and 80° C. or less. When the glass transition temperature Tg is 80° C. or less, the low-temperature fixability may be sufficiently provided. When the glass transition temperature Tg is 40° C. or more, thermal stability and storability of fixed images may be sufficiently provided. The molecular weight (weight-average molecular weight Mw) of the polyester resin may be 10,000 or more and 100,000 or less in view of productivity of the resin, fine dispersibility in toner production, and compatibility during melting.

Alternatively, such a low-temperature fixing toner TN may contain a crystalline polyester resin serving as a binder resin.

In this case, by containing the crystalline polyester resin, the low-temperature fixability may be enhanced and the amount of ammonia released from the toner during the fixing step may be decreased. The crystalline polyester resin may have a melting point of 50° C. or more and 100° C. or less. When the melting point is 50° C. or more, storability of the toner and storability of toner images having been fixed may be sufficiently provided. When the melting point is 100° C. or less, the low-temperature fixability may be easily achieved.

Hereinafter, exemplary embodiments of the invention will be described in detail with reference to attached drawings.

First Exemplary Embodiment

Overall Configuration of Image Forming Apparatus

Figure 2:
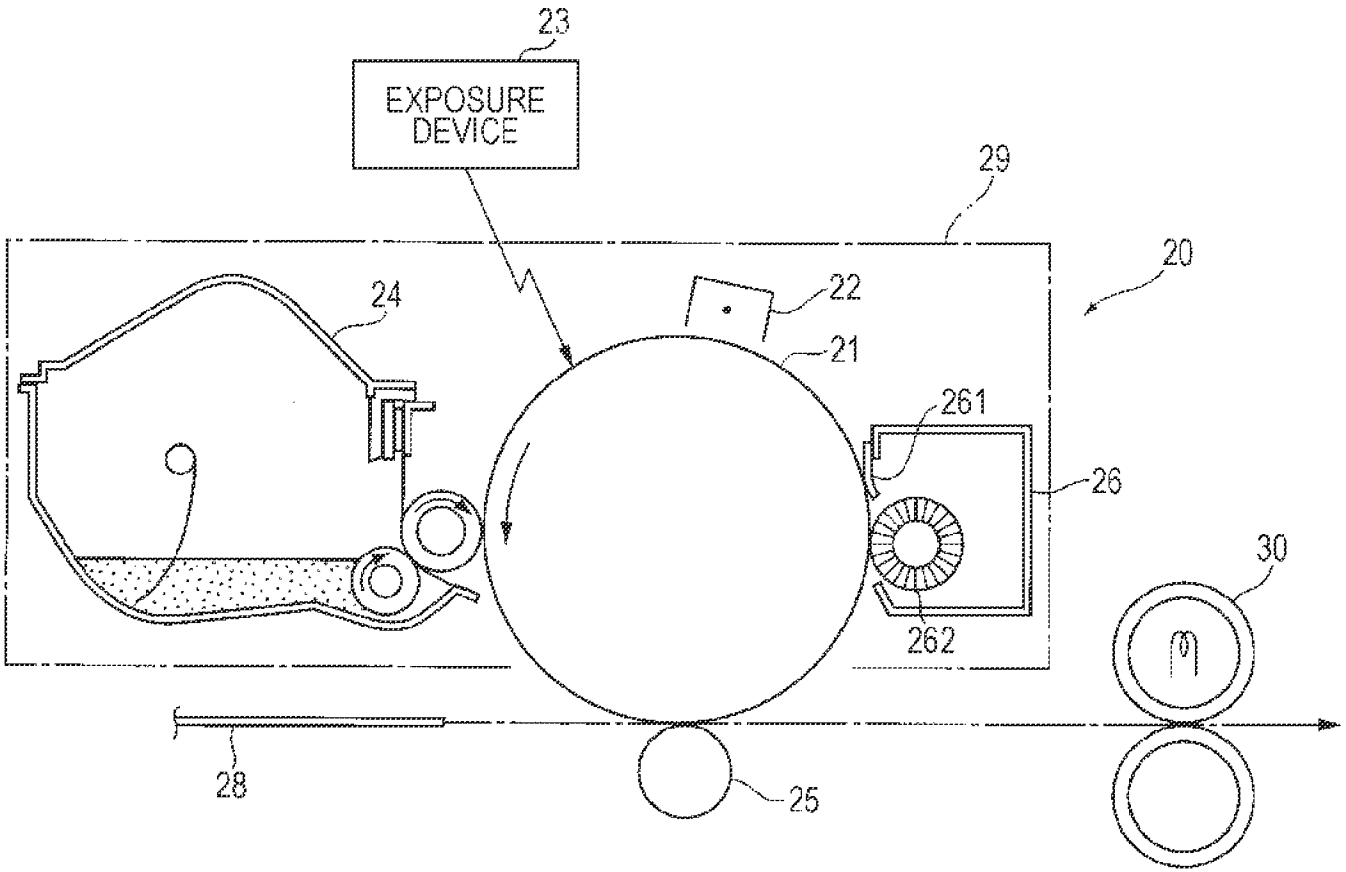
FIG. 2 is an explanatory view illustrating the overall configuration of an image forming apparatus according to a first exemplary embodiment.

FIG. 2 is an explanatory view illustrating the overall configuration of an image forming apparatus according to a first exemplary embodiment.

In FIG. 2, an image forming apparatus 20 includes a drum-shaped photoconductor 21 serving as an image carrier; a charging device 22 that charges the photoconductor 21; an exposure device 23 that draws an electrostatic latent image with light on the photoconductor 21 having been charged with the charging device 22; a developing device 24 that visualize with a developer (toner) the electrostatic latent image drawn on the photoconductor 21; a transfer device 25 that transfers a toner image provided by the developing device 24, onto a recording material 28 serving as a transfer medium; and a cleaning device 26 that cleans residual toner remaining on the photoconductor 21 after the toner image is transferred with the transfer device 25.

In the exemplary embodiment, the transfer image having been transferred onto the recording material 28 is fixed with a fixing device 30 and the recording material 28 is then discharged. In the exemplary embodiment, the recording material 28 is described as an example of the transfer medium. However, the transfer medium is not limited to the recording material 28 and may also include an intermediate transfer body that temporarily carries the toner image prior to the transfer onto the recording material 28.

Figure 3:
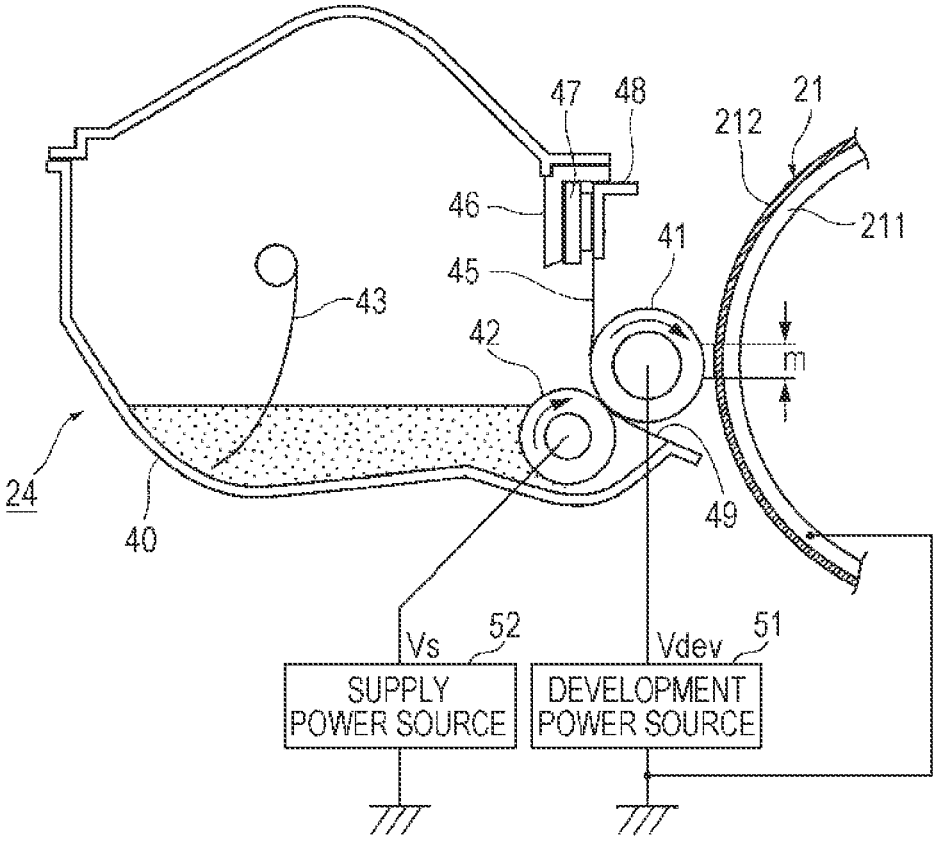
FIG. 3 is an explanatory view illustrating a portion of a developing device according to a first exemplary embodiment.

Referring to FIG. 3, the photoconductor 21 may be, for example, a member in which a photosensitive layer 212 is formed on a drum-shaped metal frame body 211. The charging device 22 includes, for example, a charge container in which a discharge wire serving as a charging member is disposed. However, the charging device 22 is not limited to this configuration and may be appropriately selected. For example, a roller-shaped charging member may be used.

The exposure device 23 may be, for example, a laser scanning device or a LED array.

The developing device 24 may be a device employing a monocomponent development mode using a nonmagnetic toner. The developing device 24 will be described further in detail below.

The transfer device 25 is a device to which a transfer electric field is applied to allow electrostatic transfer of the toner image on the photoconductor 21 onto the recording material 28. The transfer device 25 may be, for example, a roller-shaped transfer member to which a transfer bias is applied. However, the transfer device 25 is not limited to this configuration and may be appropriately selected. For example, a transfer corotron employing a discharge wire may be used.

The cleaning device 26 illustrated includes a cleaning container that opens to the photoconductor 21 and contains residual toner; in the opening of the cleaning container, a plate-shaped cleaning member 261 such as a blade or a scraper is disposed at the downstream rim of the opening in the rotation direction of the photoconductor 21, and a brush-shaped or roller-shaped rotation cleaning member 262 is disposed upstream of the plate-shaped cleaning member 261 in the rotation direction of the photoconductor 21. However, the cleaning device 26 is not limited to this configuration and may be appropriately selected.

Some or all of the photoconductor 21, the charging device 22, the developing device 24, and the cleaning device 26 may be assembled as a process cartridge 29 serving as an image forming assembly and may be detachably mounted to a receiving portion provided in the housing of an image forming apparatus.

Developing Device

Figure 4:
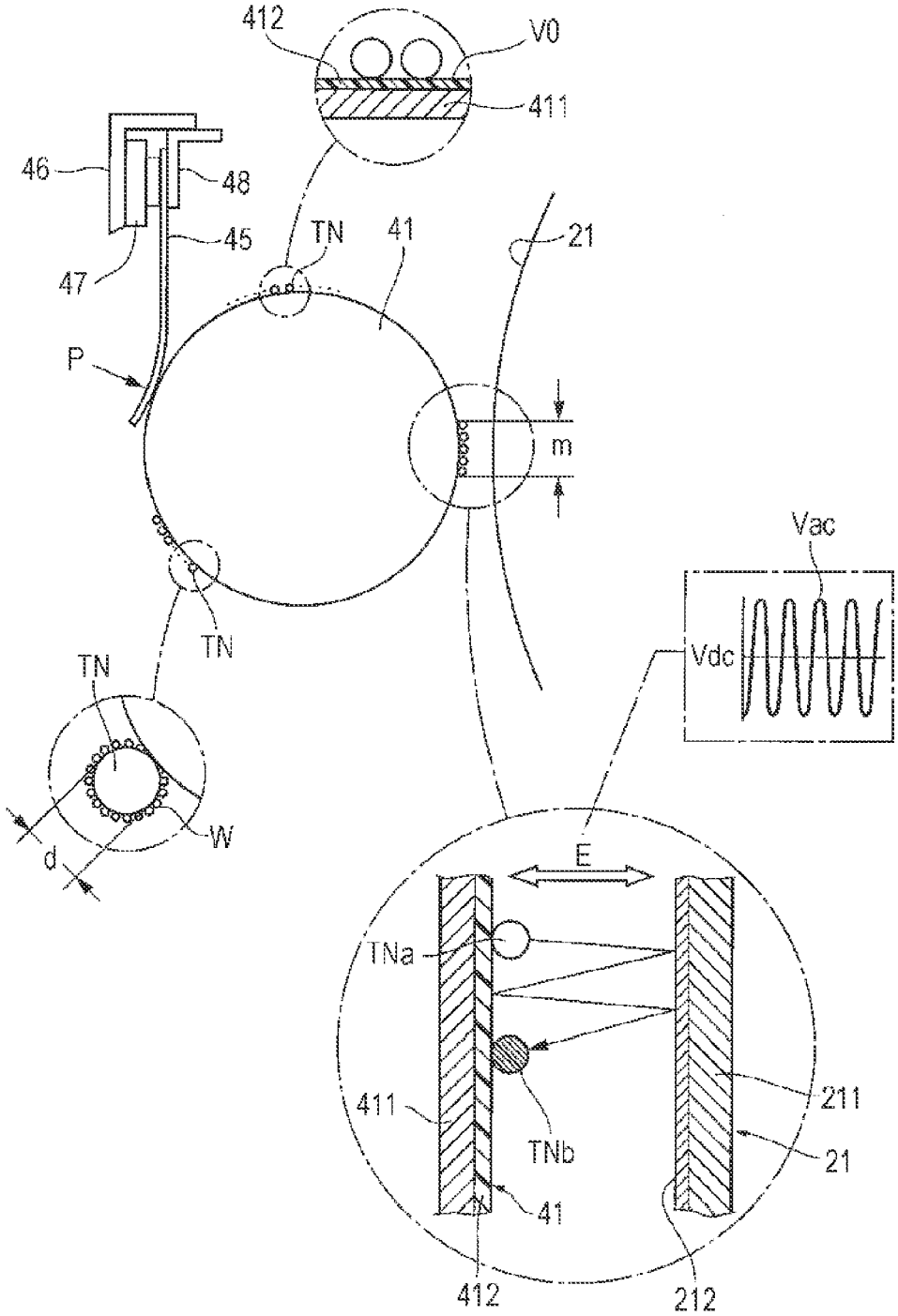
FIG. 4 is an explanatory view illustrating conditions for a toner, a development roller, and a developing electric field of a developing device used in an exemplary embodiment.

In the exemplary embodiment, referring to FIGS. 2 to 4, the developing device 24 includes a developing container 40 that contains the nonmagnetic toner TN and opens to the photoconductor 21; at a position facing the opening of the developing container 40, a development roller 41 is disposed; on the backside of the development roller 41, a supply roller 42 that supplies the nonmagnetic toner TN in the developing container 40 is disposed; and, in the developing container 40, an agitator 43 serving as an agitation feed member that agitates and feeds the nonmagnetic toner TN toward the supply roller 42 is disposed.

In the exemplary embodiment, the development roller 41 and the supply roller 42 rotate clockwise. The supply roller 42 supplies the nonmagnetic toner TN to the development roller 41. The development roller 41 carries the nonmagnetic toner TN to the development region m facing the photoconductor 21. Thus, the nonmagnetic toner TN is used for development in the development region m.

A plate-shaped charging blade 45 is disposed on a portion of the development roller 41, the portion being downstream of a portion where the toner is supplied by the supply roller 42 in the toner carrying direction. For example, the charging blade 45 is constituted by a metal plate formed of phosphor bronze; an end of the charging blade 45 is fixed on the opening rim of the developing container 40; the charging blade 45 extends in a direction opposite to the rotation direction of the development roller 41; and the charging blade 45 is pressed onto the surface of the development roller 41 at a predetermined pressure P. Thus, the toner TN being carried by the development roller 41 is passed through the press contact portion between the charging blade 45 and the development roller 41 so that the toner TN is frictionally charged and the amount of the toner TN is adjusted to be a predetermined carrying amount.

The charging blade 45 is fixed as follows. A bracket 46 is attached to the opening rim of the developing container 40; and the base end of the charging blade 45 is held between the bracket 46 and a holder 48 with a spacer 47 disposed between the bracket 46 and the charging blade 45.

In a lower rim of the opening of the developing container 40, an end of a sealing member 49 constituted by an elastic member is fixed. A free end of the sealing member 49 is elastically disposed so as to be in contact with a portion of the development roller 41, the portion being upstream of a portion where the toner is supplied by the supply roller 42 in the toner carrying direction. Thus, the gap between the development roller 41 and the developing container 40 is sealed.

In the exemplary embodiment, a development power source 51 that forms a developing electric field between the development roller 41 and the photoconductor 21 is disposed. For the supply roller 42, a supply power source 52 that forms a supply electric field for supplying the nonmagnetic toner TN to the development roller 41 is disposed.

In the exemplary embodiment, the development power source 51 applies a development voltage Vdev in which an alternating current component Vac is superimposed on a direct current component Vdc to the development roller 41. The supply power source 52 applies a supply voltage Vs in which a direct current component has a determined potential difference relative to the direct current component Vdc of the development power source 51 and an alternating current component having the same period as the alternating current component Vac of the development power source 51 is superimposed on the direct current component.

Toner

In the exemplary embodiment, the nonmagnetic toner TN is a toner that is fixed at a low fixing temperature (for example, about 120° C. to about 140° C.) and has a small average particle diameter d of 6.5 μm or less. Specifically, the nonmagnetic toner TN contains a binder resin, a colorant, a release agent, and other additives.

Hereinafter, these components will be described.

Binder Resin

The binder resin at least contains a polyester resin. The polyester resin has an acid value of 5 mgKOH/g or more and 25 mgKOH/g or less, preferably 6 mgKOH/g or more and 23 mgKOH/g or less.

When the polyester resin has an acid value of 5 mgKOH/g or more, the toner has a high affinity for paper and high chargeability. In addition, when the toner is produced by an emulsion aggregation method described below, emulsion particles may be easily produced and an excessive increase in an aggregation rate in an aggregation step or in a deformation rate in a coalescence step may be suppressed. Accordingly, control of the particle diameter and control of the shape may be easily achieved.

When the polyester resin has an acid value of 25 mgKOH/g or less, environment dependency of chargeability is less likely to be adversely affected. In addition, when the toner is produced by an emulsion aggregation method described below, an excessive decrease in an aggregation rate in an aggregation step or in a deformation rate in a coalescence step may be suppressed. Accordingly, degradation of productivity may be suppressed.

The polyester resin is obtained by, for example, polycondensation between a polycarboxylic acid and a polyhydric alcohol.

Examples of the polycarboxylic acid include aromatic carboxylic acids such as terephthalic acid, isophthalic acid, phthalic anhydride, trimellitic anhydride, pyromellitic acid, and naphthalenedicarboxylic acid; aliphatic carboxylic acids such as maleic anhydride, fumaric acid, succinic acid, alkenyl succinic anhydride, and adipic acid; and alicyclic carboxylic acids such as cyclohexanedicarboxylic acid. These polycarboxylic acids may be used alone or in combination.

Of these polycarboxylic acids, aromatic carboxylic acids are preferably used. To provide high fixability, the polyester resin may have a crosslinked structure or a branched structure. To obtain such a polyester resin, a dicarboxylic acid and a carboxylic acid that has three or more carboxylic groups (for example, trimellitic acid or trimellitic anhydride) are preferably used in combination as the polycarboxylic acids.

Examples of the polyhydric alcohol include aliphatic diols such as ethylene glycol, diethylene glycol, triethylene glycol, propylene glycol, butanediol, hexanediol, neopentyl glycol, and glycerin; alicyclic diols such as cyclohexanediol, cyclohexanedimethanol, and hydrogenated bisphenol A; and aromatic diols such as ethylene oxide adducts of bisphenol A and propylene oxide adducts of bisphenol A. These polyhydric alcohols may be used alone or in combination.

Of these polyhydric alcohols, aromatic diols and alicyclic diols are preferred and, in particular, aromatic diols are more preferred. To provide high fixability, the polyester resin may have a crosslinked structure or a branched structure. To obtain such a polyester resin, a diol and a polyhydric alcohol that has three or more hydroxy groups (for example, glycerin, trimethylolpropane, or pentaerythritol) are preferably used in combination as the polyhydric alcohols.

The glass transition temperature (hereafter sometimes abbreviated as "Tg") of the polyester resin is preferably 40° C. or more and 80° C. or less, more preferably 50° C. or more and 70° C. or less. When the polyester resin has a Tg of 80° C. or less, low-temperature fixability may be provided. When the polyester resin has a Tg of 40° C. or more, sufficiently high thermal stability and storability of fixed images may be provided.

The molecular weight (weight-average molecular weight Mw) of the polyester resin may be 10,000 or more and 100, 000 or less in view of productivity of the resin, fine dispersibility in toner production, and compatibility during toner melting.

Crystalline Polyester Resin

The polyester resin may contain a crystalline polyester resin. When the polyester resin contains a crystalline polyester resin, the low-temperature fixability of the toner is enhanced. As a result, the amount of ammonia released from the toner during the fixing step is decreased and the odor is reduced. Even when the amount of ammonia released during the fixing step is small, since the heating temperature is low, deterioration of the fixing unit is suppressed.

When the polyester resin contains a crystalline polyester resin and an amorphous polyester resin, during toner melting, the crystalline polyester resin becomes compatible with the amorphous polyester resin to considerably decrease the toner viscosity. As a result, a toner excellent in terms of low-temperature fixability and image glossiness is provided.

Among crystalline polyester resins, aliphatic crystalline polyester resins are preferred because many of them have suitable melting points, compared with aromatic crystalline polyester resins.

The content of a crystalline polyester resin in the polyester resin is preferably 2% by mass or more and 20% by mass or less, more preferably 2% by mass or more and 14% by mass or less. When the content of a crystalline polyester resin is 2% by mass or more, during melting, the viscosity of the amorphous polyester resin may be sufficiently decreased and the low-temperature fixability is likely to be enhanced. When the content of a crystalline polyester resin is 14% by mass or less, degradation of chargeability of the toner due to the presence of the crystalline polyester resin may be suppressed and high durability of images having been fixed on recording media is likely to be achieved.

The crystalline polyester resin preferably has a melting point in the range of 50° C. or more and 100° C. or less, more preferably in the range of 55° C. or more and 95° C. or less, still more preferably in the range of 60° C. or more and 90° C. or less. When the crystalline polyester resin has a melting point of 50° C. or more, high storability of the toner and high storability of toner images having been fixed are achieved. When the crystalline polyester resin has a melting point of 100° C. or less, the low-temperature fixability is likely to be enhanced.

In the exemplary embodiment, the term "crystalline polyester resin" denotes a resin that provides not stepwise endothermic changes but a clear endothermic peak in differential scanning calorimetry (hereafter sometimes abbreviated as "DSC"). In the case where a crystalline polyester resin is a polymer in which another component is bonded to the backbone by copolymerization, when the content of the other component is 50% by mass or less, this copolymer is also referred to as a crystalline polyester resin.

In the exemplary embodiment, when the polyester resin is a mixture of a crystalline polyester resin and an amorphous polyester resin, the term "acid value of the polyester resin" denotes the acid value of the mixture.

The crystalline polyester resin is synthesized from an acid (dicarboxylic acid) component and an alcohol (diol) component. In descriptions below, an "acid-derived unit" in the crystalline polyester resin denotes a moiety that is derived from the acid component in the synthesis of the polyester resin; and an "alcohol-derived unit" in the crystalline polyester resin denotes a moiety that is derived from the alcohol component in the synthesis of the polyester resin.

Acid-Derived Unit

An acid for forming the acid-derived unit may be selected from various dicarboxylic acids. In an exemplary embodiment, an acid-derived unit in a crystalline polyester resin is desirably derived from a straight-chain aliphatic dicarboxylic acid.

Non-limiting examples of the straight-chain aliphatic dicarboxylic acid and derivatives thereof include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid, lower alkyl esters of the foregoing, and anhydrides of the foregoing. Of these, adipic acid, sebacic acid, and 1,10-decanedicarboxylic acid are preferred in view of ease of availability.

Other acid-derived units may include, for example, dicarboxylic acid-derived units having a double bond and dicarboxylic acid-derived units having a sulfo group.

Herein, "mol %" denotes percentage in which, in the polyester resin, an acid-derived unit relative to all the acid-derived units or an alcohol-derived unit relative to all the alcohol-derived units is defined as a single unit (mole).

Alcohol-Derived Unit

An alcohol forming the alcohol-derived unit may be selected from aliphatic diols. Non-limiting examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-dodecanediol, 1,12-undecanediol, 1,13-tridecanediol, 1,14-tetradecanediol, 1,18-octadecanediol, and 1,20-eicosanediol. Of these, 1,4-butanediol, 1,6-hexanediol, 1,8-octanediol, 1,9-nonanediol, and 1,10-decanediol are preferred in view of ease of availability and the cost.

The molecular weight (weight-average molecular weight Mw) of the crystalline polyester resin is preferably 8,000 or more and 40,000 or less, more preferably 10,000 or more and 30,000 or less, in view of productivity of the resin, fine dispersibility in toner production, and compatibility during toner melting. When the molecular weight is 8,000 or more, a decrease in the resistance of the crystalline polyester resin may be suppressed and hence degradation of chargeability may be suppressed. When the molecular weight is 40,000 or less, the resin synthesis cost may be reduced and degradation of the sharp melting property may be suppressed. Accordingly, the low-temperature fixability is not adversely affected.

In the exemplary embodiment, the molecular weight of the polyester resin is determined through measurement by gel permeation chromatography (GPC) and calculation. Specifically, the polyester resin is measured by GPC with a HLC-8120 manufactured by Tosoh Corporation in which a TSKgel Super HM-M (15 cm) manufactured by Tosoh Corporation is used as a column and a THF solvent is used. A molecular weight calibration curve prepared with monodisperse polystyrene standard samples is subsequently used to calculate the molecular weight of the polyester resin.

Method for Producing Polyester Resin

A method for producing the polyester resin is not particularly limited. The polyester resin may be produced by a standard polyester polymerization method in which a reaction between an acid component and an alcohol component is caused. For example, depending on the types of the monomers, a method is selected from direct polycondensation, ester interchange, and the like. The molar ratio (acid component/alcohol component) in the reaction between the acid component and the alcohol component varies depending on, for example, reaction conditions, and hence is not limited. In general, this molar ratio may be about 1/1 to achieve a high molecular weight.

Examples of a catalyst usable in the production of the polyester resin include compounds of alkali metals such as sodium and lithium; compounds of alkaline-earth metals such as magnesium and calcium; compounds of metals such as zinc, manganese, antimony, titanium, tin, zirconium, and germanium; phosphite compounds; phosphate compounds; and amine compounds.

A resin other than the polyester resin may be additionally used as another binder resin. Examples of such a resin include ethylene-based resins such as polyethylene and polypropylene; styrene-based resins such as polystyrene and α-polymethylstyrene; (meth)acrylic-based resins such as polymethyl methacrylate and polyacrylonitrile; polyamide resins; polycarbonate resins; polyether resins; and copolymer resins of the foregoing.

The content of the polyester resin in the binder resin may be 60% or more.

Colorant

The toner of the exemplary embodiment contains a colorant. The colorant may be a dye or a pigment. In view of light resistance and water resistance, a pigment may be used.

Examples of usable known pigments include carbon black, aniline black, aniline blue, calco oil blue, chrome yellow, ultramarine blue, Dupont oil red, quinoline yellow, methylene blue chloride, phthalocyanine blue, malachite green oxalate, lamp black, rose bengal, quinacridone, benzidine yellow, C.I. Pigment Red 48:1, C.I. Pigment Red 57:1, C.I. Pigment Red 122, C.I. Pigment Red 185, C.I. Pigment Red 238, C.I. Pigment Yellow 12, C.I. Pigment Yellow 17, C.I. Pigment Yellow 180, C.I. Pigment Yellow 97, C.I. Pigment Yellow 74, C.I. Pigment Blue 15:1, and C.I. Pigment Blue 15:3.

The content of the colorant with respect to 100 parts by mass of the binder resin may be 1 part by mass or more and 30 parts by mass or less.

Optionally, a surface-treated colorant or a pigment dispersing agent may be used. By appropriately selecting a colorant from the above-described colorants, for example, a yellow toner, a magenta toner, a cyan toner, or a black toner may be obtained.

Release Agent

The toner of the exemplary embodiment may optionally contain a release agent. Examples of the release agent include paraffin waxes such as low molecular weight polypropylene and low molecular weight polyethylene; silicone resins; rosins; rice wax; and carnauba wax. Such a release agent preferably has a melting point of 50° C. or more and 100° C. or less, more preferably 60° C. or more and 95° C. or less.

The content of the release agent in the toner is preferably 0.5% by mass or more and 15% by mass or less, more preferably 1.0% by mass or more and 12% by mass or less. When the content of the release agent is 0.5% by mass or more, the occurrence of peeling failure in oilless fixing may be suppressed. When the content of the release agent is 15% by mass or less, degradation of fluidity of the toner may be suppressed and hence reliability in terms of image quality and image forming may be maintained.

Other Additives

The toner of the exemplary embodiment may optionally contain, in addition to the above-described components, various components such as an internal additive, a charge control agent, an inorganic powder (inorganic particles), and organic particles.

Examples of the internal additive include magnetic substances such as metals, alloys, and compounds containing such metals: for example, ferrite, magnetite, reduced iron, cobalt, nickel, and manganese.

Examples of the charge control agent include quaternary ammonium salt compounds, nigrosine-based compounds, dyes composed of complexes containing aluminum, iron, or chromium, and triphenylmethane-based pigments.

The inorganic particles may be added for various purposes, for example, adjustment of the viscoelasticity of the toner. As a result of the viscoelasticity adjustment, image glossiness or the penetrability of the toner into paper may be adjusted. Examples of the inorganic particles include known inorganic particles such as silica particles, titanium oxide particles, alumina particles, cerium oxide particles, particles of the foregoing of which surfaces have been treated to be hydrophobic. These particles may be used alone or in combination. In view of not degrading color developability or transparency such as OHP transparency, silica particles having a lower refractive index than the binder resin are preferably used. The silica particles may be particles having been subjected to various surface treatments. For example, the silica particles may be preferably surface-treated with a silane-based coupling agent, a titanium-based coupling agent, a silicone oil, or the like.

External Additive

In the exemplary embodiment, an external additive W such as a fluidizer or an aid may be added to the toner particle surfaces. Examples of the external additive W include known particles: inorganic particles such as silica particles of which surfaces have been made hydrophobic, titanium oxide particles, alumina particles, cerium oxide particles, and carbon black particles; and particles of polymers such as polycarbonate, polymethyl methacrylate, and silicone resins. Of these, two or more external additives W are preferably used in combination where at least one of the external additives W has an average primary particle diameter in the range of 30 nm or more and 200 nm or less, preferably in the range of 30 nm or more and 180 nm or less.

When the toner TN has a small particle diameter, the non-electrostatic adhesion of the toner TN to the photoconductor 21 is increased. Thus, transfer failure or print defects of fine lines may be caused and transfer unevenness may be caused in overprint images. By adding such an external additive having a large average primary particle diameter in the range of 30 nm or more and 200 nm or less, the transfer properties may be enhanced.

Method for Producing Electrostatic Development Toner

In the exemplary embodiment, a method for producing a toner may include a step of forming toner particles by a wet production process (such as aggregation coalescence process, suspension polymerization, dissolution suspension granulation process, dissolution suspension process, or dissolution emulsion aggregation coalescence process) and a step of cleaning the toner particles.

As described above, suitable examples of the process for forming toner particles include wet production processes. In particular, emulsion aggregation processes are preferred and an emulsion aggregation process employing a phase inversion emulsification is more preferred.

Such an emulsion aggregation process is performed as follows. Dispersion liquids (such as an emulsion and a pigment dispersion liquid) containing components (such as a binder resin and a colorant) to be contained in the toner are individually prepared. These dispersion liquids are mixed together to aggregate the toner components into aggregated particles. These aggregated particles are then heated to a temperature equal to or higher than the melting point or the glass transition temperature of the binder resin so as to be coalesced.

The emulsion aggregation process is likely to provide toners having a small particle diameter and a narrow and uniform particle size distribution, compared with dry processes such as a kneading pulverization process and other wet processes such as a melting suspension process and a dissolution suspension process. In addition, compared with these wet processes such as a melting suspension process and a dissolution suspension process, the emulsion aggregation process allows easy shape control and uniform formation of irregularly shaped toners. Furthermore, in the emulsion aggregation process, since the toner structure is controlled by, for example, coating-film formation, surface exposure of a release agent and a crystalline polyester resin, if present, is suppressed and hence degradation of chargeability and storability is suppressed.

Development Roller

In the exemplary embodiment, referring to FIG. 4, the development roller 41 includes a roller body 411 formed of a metal such as aluminum and a cover layer 412 that covers the surface of the roller body 411 and is formed of a resin such as a urethane-based resin, a nylon-based resin, or a styrene-based resin. The development roller 41 is adjusted such that $V0/d<6.8\times10^{-4}$ is satisfied where d (μm) represents an average particle diameter of the toner TN and, regarding surface roughness of the development roller 41, V0 represents an oil retention volume corresponding to a volume of oil retained for an oil retention depth Rvk relative to a surface area of 1 $cm^2$.

Oil Retention Volume V0

Figures 5A, 5B:
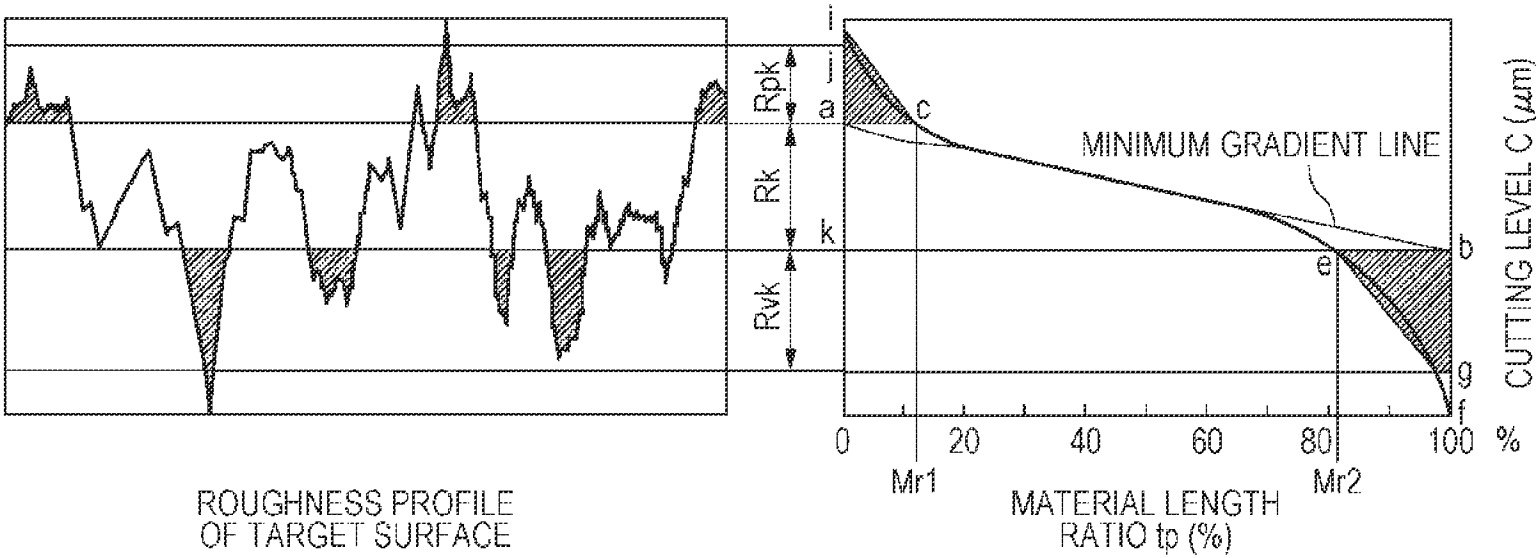
FIG. 5A illustrates graphs of a roughness profile and a material length ratio of a target surface of a development roller used in a first exemplary embodiment.
FIG. 5B is a numerical formula for calculating an oil retention volume serving as an index of the surface roughness of a development roller.

The oil retention volume V0 is calculated by the following numerical formula, which is also described in FIG. 5B, $$V0 = \frac{(100 - Mr2) \times Rvk}{2000} (\mu m).$$

In this formula, the oil retention volume V0 is calculated as a function of the oil retention depth Rvk and an oil retention length Mr2.

Figures 6A, 6B:
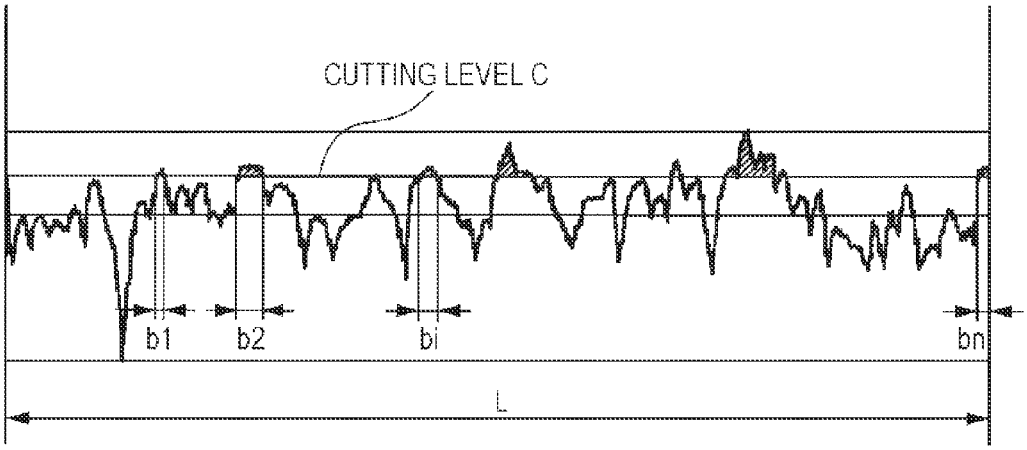
FIG. 6A is an explanatory view schematically illustrating the relationship between the roughness profile and the material length ratio of a development roller.
FIG. 6B is an explanatory view illustrating a numerical formula for calculating a material length ratio.

From a roughness profile of a target surface in FIG. 5A, a portion of the roughness profile is sampled for a sampling length L as illustrated in FIG. 6A. When this sampled portion of the roughness profile is cut at a cutting level C parallel to the peak line, sum of the lengths of the cut portions (material length ηp) is obtained. The percentage of the material length ηp with respect to the sampling length L is defined as a material length ratio tp (refer to FIG. 6B).

The material length ratio tp indicates data in the height direction and data in the lateral direction; values of tp (%) and cutting level C (μm) are described in combination.

Referring to FIG. 5A, among lines passing two points on the curve of the material length ratio tp, the two points having a difference of 40% in tp, a line having the minimum gradient (minimum gradient line) is determined. A point on this line at tp 0% is defined as "a". A point on this line at tp 100% is defined as "b". A point of intersection of a cutting level C passing through the point b and the curve of the material length ratio tp is defined as "e". A point on the curve of the material length ratio tp at tp 100% is defined as "f". A point "g" at tp 100% is determined such that an area formed by segments be and bf and a curve of equals to the area of a triangle beg. The distance between the points b and g is defined as Rvk. The tp value of the point e is defined as Mr2.

A point of intersection of a cutting level C passing through the point a and the curve of the material length ratio tp is defined as "c". A point on the curve of the material length ratio tp at tp 0% is defined as "i". A point "j" at tp 0% is determined such that an area formed by segments ac and ai and a curve ci equals to the area of a triangle acj. A point on the cutting level C passing through the point b, at tp 0%, is defined as "k". The distance between the points a and j is defined as an initial wear height Rpk. The tp value of the point c is defined as an initial wear length Mr1. The distance between the points a and k is defined as a material core roughness Rk.

Relationship Between Oil Retention Volume and Toner Particle Diameter

The oil retention volume V0 is an index relating to smoothness among surface roughness properties. Even when the oil retention volume V0 representing the surface roughness of the development roller 41 is the same, depending on the magnitude of the toner particle diameter d, the influence of the surface roughness on the toner probably varies. Accordingly, in the exemplary embodiment, when a relative ratio "V0/d" of the oil retention volume V0 to the toner particle diameter d is the same, the influence of the surface roughness on the toner is assumed to be the same. Thus, "V0/d" is employed as the parameter representing the surface roughness of the development roller 41.

Determination of Threshold Value

The threshold value of "V0/d" representing the surface roughness of the development roller 41 is determined in the following manner. A threshold value V0th of the oil retention volume V0 at which the non-electrostatic adhesion to toner particles having a predetermined particle diameter d becomes 2 nN is determined. A development roller 41 having a surface roughness in which the oil retention volume V0 equals to the threshold value is used; when a predetermined developing electric field is formed between the development roller 41 and the photoconductor 21, the diameter dth of toner particles that start to fly is determined. From the determined value, V0th/dth is calculated.

The threshold value will be described in detail in Examples below.

Method for Adjusting Oil Retention Volume V0

An example of a method for adjusting the oil retention volume V0 representing the surface roughness of the development roller 41 is as follows. In grinding of the surface of the roller body 411 with a cylindrical grinder, a grinding tool (such as a grindstone) having a predetermined surface roughness is selected; the surface of the roller body 411 is ground with the grinding tool under predetermined grinding conditions; and the cover layer 412 formed of a resin is then formed by, for example, spray coating on the surface of the roller body 411.

In the exemplary embodiment, since the cover layer 412 is uniformly formed as a thin film by spray coating so as to conform to the surface of the roller body 411, the surface roughness of the resultant development roller 41 corresponds to the surface roughness of the roller body 411. When the surface roughness of the development roller 41 is higher than that of the roller body 411, the development roller 41 including the cover layer 412 may be subjected to surface finishing.

Method for Calculating Non-Electrostatic Adhesion

Figures 7A, 7B:
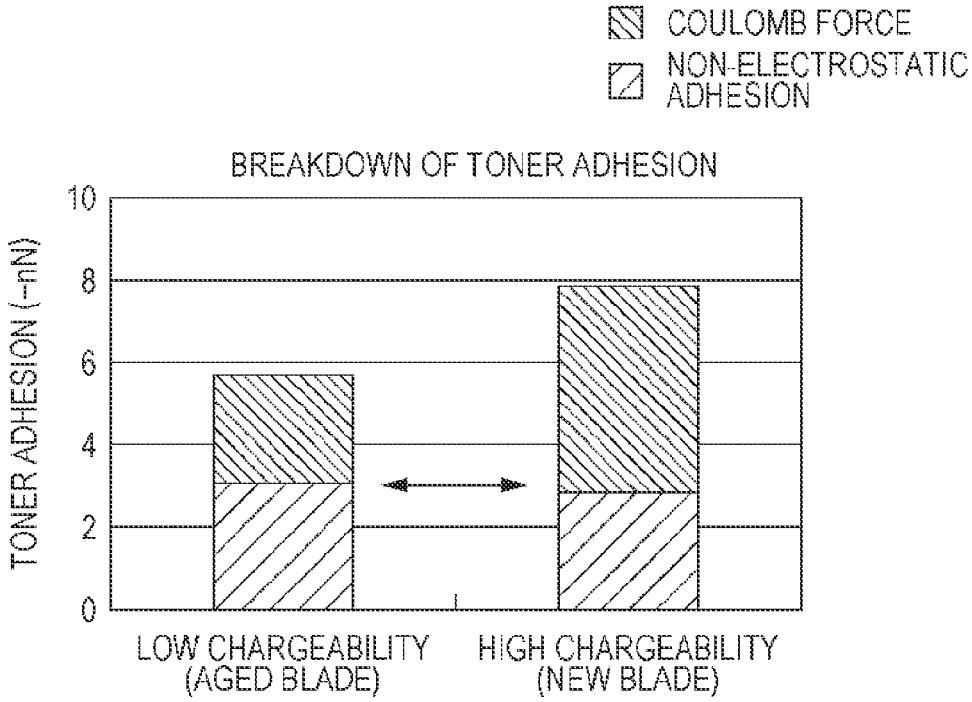
FIG. 7A is an explanatory view illustrating a numerical formula for calculating a toner adhesion to the surface of a development roller.
FIG. 7B is an explanatory view of an example in which the toner adhesion is broken down into Coulomb force, which is an electrostatic adhesion, and a non-electrostatic adhesion.

The toner adhesion F to the development roller 41 is calculated by a numerical formula in FIG. 7A.

In this numerical formula, the first term "$A(Q/d)^2$" corresponds to Coulomb force (electrostatic adhesion) depending on the charge of the toner; the second term "Bd" represents non-electrostatic adhesion such as Van der Waals force.

In the formula, "Q" represents the charge of the toner; "d" represents the particle diameter of the toner; and "A" and "B" represent coefficients.

The toner adhesion F is determined as follows. The charge amount distribution of toner particles is measured with a particle charge amount distribution measurement system 60 (refer to FIG. 8) in which the development voltage of the development power source 51 composed of a direct current component Vdc alone is varied. From the measurement result, a development curve (refer to FIG. 9) as a function of the development voltage composed of the direct current component Vdc is drawn. In the development curve, the toner adhesion F is determined from the charge Q of the toner and the developing electric field E (Vdev/DRS (drum roll space: space between drum-shaped photoconductor and development roller)) at the toner flying start point. In the development curve in FIG. 9, the abscissa axis indicates the development voltage Vdev and the ordinate axis indicates the developed mass per area (DMA) measured with the particle charge amount distribution measurement system 60.

In the above-described manner, for example, toner adhesions F are determined for cases under the same conditions (for example, the same toner and the same development roller) except that charging blades having different charging characteristics (for example, charging blades of the same type, but a new blade and an aged blade) are used and hence the charge amounts of the toner are different. Simultaneous equations in terms of the numerical formula in FIG. 7A are solved to determine the coefficients "A" and "B" of the numerical formula in FIG. 7A. Thus, Coulomb force and non-electrostatic adhesion are calculated (refer to FIG. 7B).

A specific method for calculating the non-electrostatic adhesion will be described in detail in Examples.

Particle Charge Amount Distribution Measurement System

The particle charge amount distribution measurement system 60 used in the exemplary embodiment is, for example, an E-spart analyzer manufactured by Hosokawa Micron Corporation.

Figure 8:
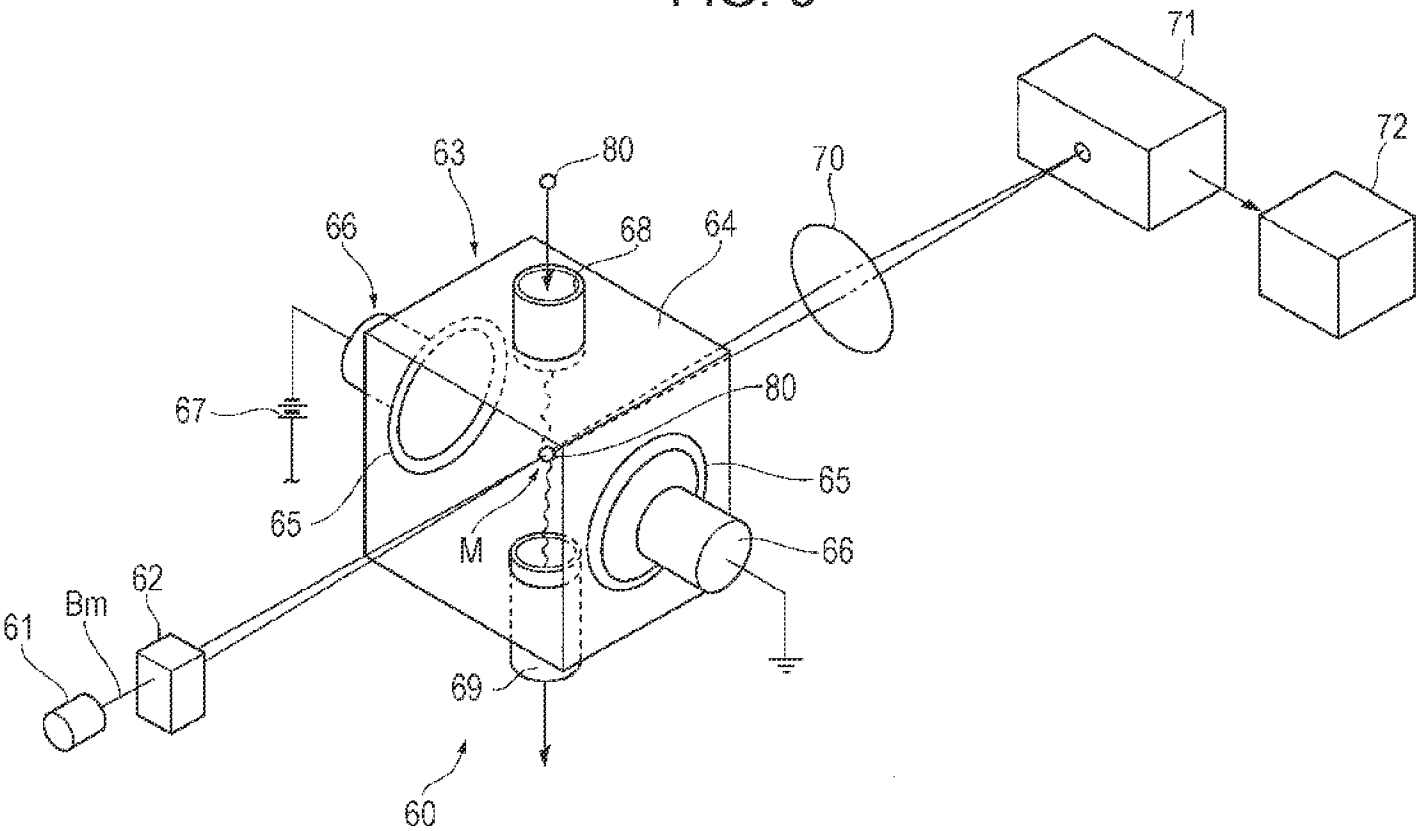
FIG. 8 is an explanatory view illustrating an example of a measurement system for measuring the charge amount distribution of a toner.
Figure 9:
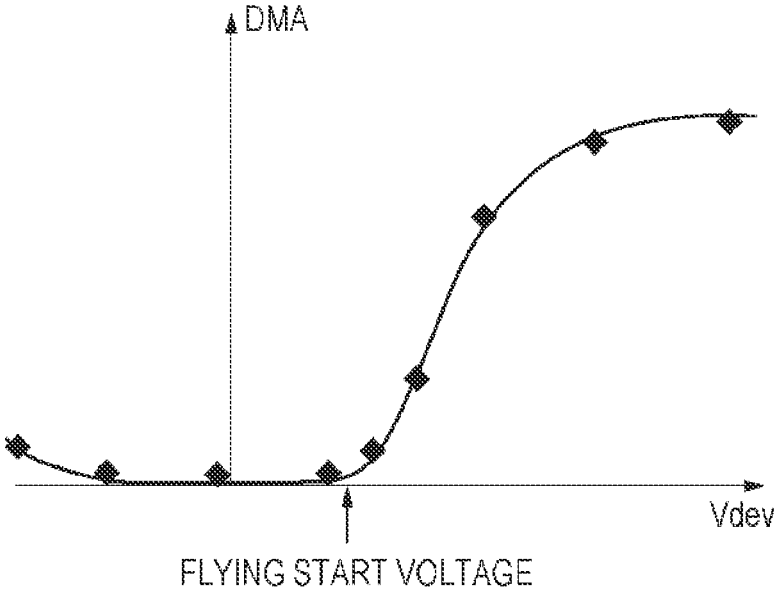
FIG. 9 is an explanatory view illustrating an example of measurement results obtained with the measurement system in FIG. 8.

Referring to FIG. 8, the particle charge amount distribution measurement system 60 basically includes a laser beam emitting device 61 that emits a laser beam; a beam splitter 62 that applies a constant frequency bias to the laser beam to split this laser beam into two beams; a measurement chamber 63 in which these split beams are introduced and applied to sample particles 80 at a measurement point M; a beam-condensing unit 70 (for example, a condenser lens) that condenses laser beams having been scattered by the sample particles 80 within the measurement chamber 63 and having been emitted from the measurement chamber 63; a detector 71 that detects condensed beams; and a computing unit 72 that calculates the charge amount data of the sample particles 80 on the basis of detection output from the detector 71.

The measurement chamber 63 includes a box-shaped container body 64. A sample particle inlet 68 is provided in the top surface of the container body 64. A sample particle outlet 69 is provided in the bottom surface of the container body 64. Sonic vibration generating mechanisms 65 are disposed in opposite side walls of the container body 64. In these opposite side walls of the container body 64 in which the sonic vibration generating mechanisms 65 are disposed, electrodes 66 that form a predetermined electric field in the measurement chamber 63 are disposed. One of the electrodes 66 is connected to a power source 67. The other one of the electrodes 66 is grounded.

Hereinafter, operations of the particle charge amount distribution measurement system 60 will be described.

The sample particles 80 being carried by nitrogen gas flow are introduced with an appropriate supply unit through the sample particle inlet 68 into the measurement chamber 63. While the introduced particles fall, under vibration caused by sonic waves from the sonic vibration generating mechanisms 65 and an electric field formed by the electrodes 66 to which a predetermined voltage is applied, in accordance with the magnitude of charge amount and the vibration, the particles are irradiated at the measurement point M with the two split laser beams. In this case, while the particles vibrate with delay with respect to the reference sonic waves in accordance with the diameter of the particles, the particles fall in a manner according to the charge amounts of the particles. The laser beams are scattered in response to the manner in which the particles fall. The scattered beams are passed through the beam-condensing unit 70 and then detected by the detector 71. The detection data is input into the computing unit 72 and calculated as a predetermined charge amount data.

Operations of Developing Device

Referring to FIG. 3, in the developing device 24 of the exemplary embodiment, the toner TN in the developing container 40 is agitated and fed by the agitator 43 to the supply roller 42; the toner TN is then supplied by the supply roller 42 to the development roller 41.

The toner TN held by the development roller 41 is then charged by being passed under the charging blade 45. The toner TN subsequently reaches the development region m between the development roller 41 and the photoconductor 21.

In this development region m, since the developing electric field E is formed, most particles of the toner TN held on the development roller 41 fly toward and adhere to an electrostatic latent image formed on the photoconductor 21. Thus, the toner TN is used for developing the electrostatic latent image.

During operations of the developing device, the toner behaves in the following manner.

Hereinafter, the case of using a new toner (toner at the initial stage of usage) and the case of using an aged toner (toner having been used over time) will be schematically individually described.

New Toner

In the exemplary embodiment, the toner TN is a low-temperature fixing toner and contains, in addition to a binder resin, a colorant, and a release agent, an additive that is an external additive W having medium or large particle diameter $\alpha$ of 30 nm or more.

Figure 10:
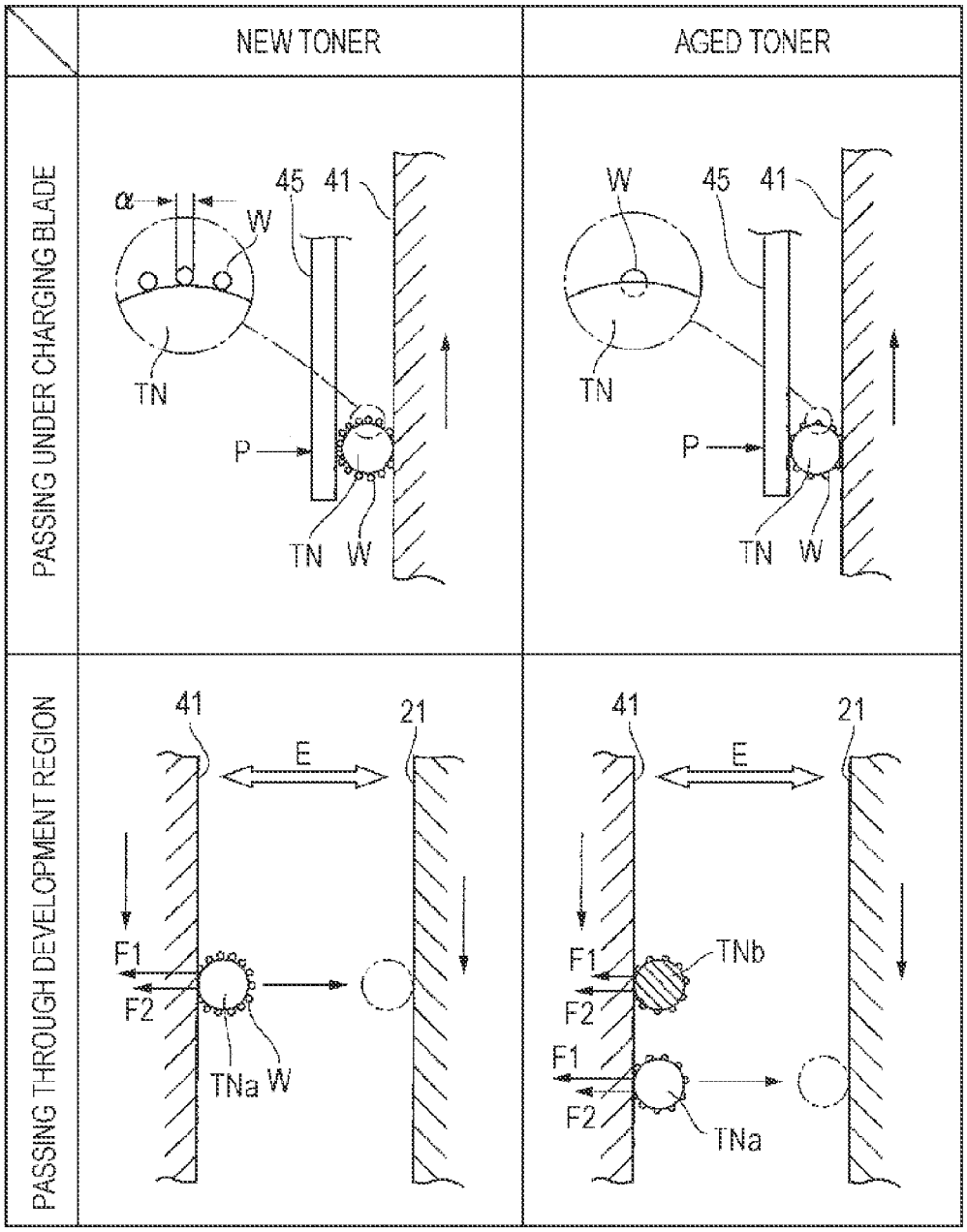
FIG. 10 is an explanatory view schematically illustrating behaviors of a toner in a developing device used in a first exemplary embodiment, at the time when the toner is passed under a charging blade and at the time when the toner is passed through a development region, in terms of a new toner and an aged toner.

At the initial stage of usage, the external additive W is substantially uniformly distributed over the entire particle surfaces of the toner TN. Accordingly, as illustrated in FIG. 10, when the toner TN is passed under the charging blade 45, the toner TN held on the development roller 41 is sufficiently frictionally charged with the charging blade 45. When the toner TN having been sufficiently frictionally charged reaches the development region m, which is under the developing electric field E based on the development voltage Vdev applied by the development power source 51, the toner TN flies toward the photoconductor 21 and adheres to an electrostatic latent image formed on the photoconductor 21 to visualize the electrostatic latent image.

Aged Toner

When the toner TN is used over time, for example, due to a mechanical stress applied by the charging blade 45, the external additive W may be separated from the particle surfaces of the toner TN or the external additive W may be partially embedded in the particle surfaces of the toner TN and remain in the form of projections on the particle surfaces of the toner TN. In such a case, when the toner TN passes under the charging blade 45, since the toner TN has a low fluidity, the probability of contact between the charging blade 45 and the particle surfaces of the toner TN is decreased, and the substantial contact area between the charging blade 45 and the particle surfaces of the toner TN is decreased. Thus, the contact failure of the toner TN tends to occur. Because of the contact failure of the toner TN, the charge amount of the toner TN becomes insufficient or the toner TN may be charged with reverse polarity. Accordingly, the improperly charged toner TNb tends to be generated. The improperly charged toner TNb adheres to the surface of the development roller 41 at a non-electrostatic adhesion (2 nN or more) that is probably similar to that of the properly charged toner TNa described below, under the predetermined environmental conditions (low temperature of 10° C. and low relative humidity of 15%). Regarding the insufficiently charged toner among the improperly charged toner TNb, an electrostatic force applied to the insufficiently charged toner by the developing electric field E is lower than to the properly charged toner TNa. Regarding the toner charged with reverse polarity among the improperly charged toner TNb, the reversed polarity charged toner is attracted by the developing electric field E toward the non-image portion of an electrostatic latent image; however, even when the properly charged toner TNa flying in the development region m attempts to take the improperly charged toner TNb along therewith or to knock the improperly charged toner TNb off, the above-described non-electrostatic adhesion suppresses flying of the improperly charged toner TNb. Accordingly, flying of the improperly charged toner TNb toward the photoconductor 21 is suppressed and the fogging phenomenon in which the improperly charged toner TNb adheres to the non-image portion of an electrostatic latent image is effectively suppressed. Even in the case of a toner TN having been used over time, when the toner TN sufficiently frictionally charged by the charging blade 45 (properly charged toner TNa) reaches the development region m, the toner TN flies toward an electrostatic latent image on the photoconductor 21 due to the developing electric field E; however, the toner TN is properly charged and does not adhere to the non-image portion of an electrostatic latent image and hence fogging is not caused.

Second Exemplary Embodiment

Figure 11:
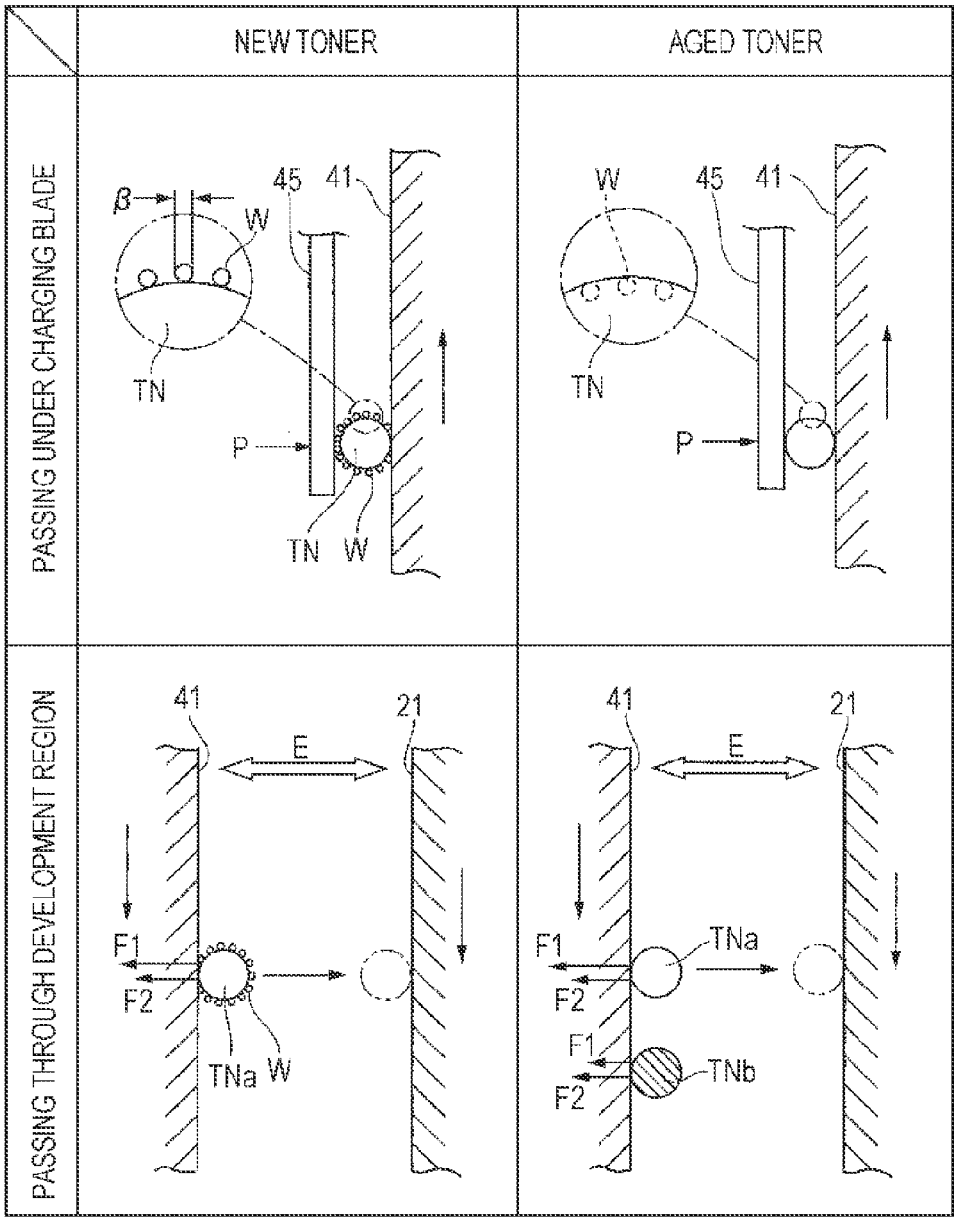
FIG. 11 is an explanatory view schematically illustrating behaviors of a toner in a developing device used in a second exemplary embodiment, at the time when the toner is passed under a charging blade and at the time when the toner is passed through a development region, in terms of a new toner and an aged toner.
Figure 12A:
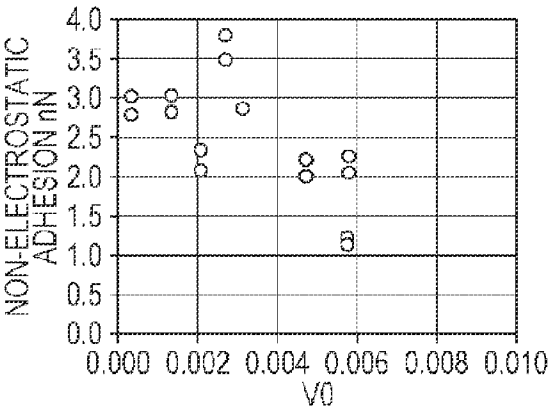
FIGS. 12A to 12D are graphs for evaluation of the surface roughness of a development roller of a developing device with various parameters in Example 1, the graphs illustrating the relationships between the non-electrostatic adhesion and indices (parameters) relating to smoothness of the surface roughness of a development roller (oil retention volume V0, oil retention depth Rvk, mean slope RΔa, and developed length ratio Rlr)
Figure 12B:
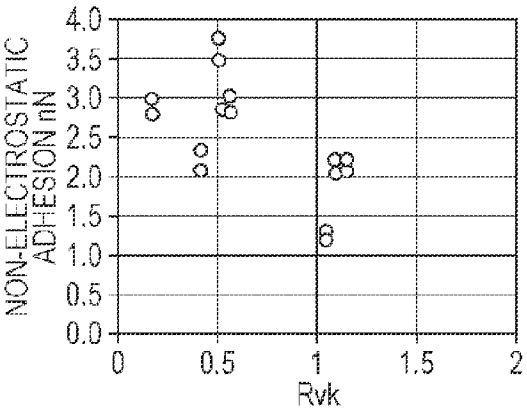
Figure 12C:
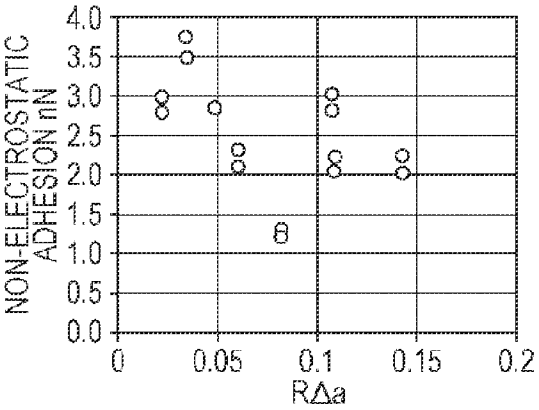
Figure 12D:
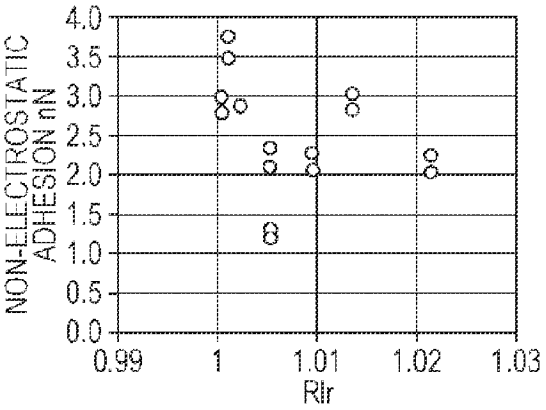
Figure 13A:
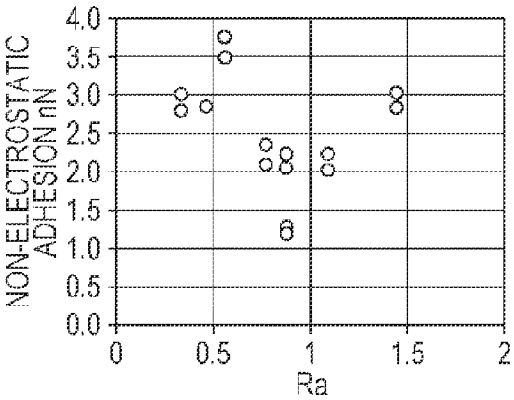
FIGS. 13A to 13D are graphs for the above-described evaluation, the graphs illustrating the relationships between the non-electrostatic adhesion and indices (parameters) relating to height of the surface roughness of a development roller (arithmetical mean roughness Ra, ten point height of roughness profile RzJIS, amplitude skewness Rsk, and amplitude kurtosis Rku)
Figure 13B:
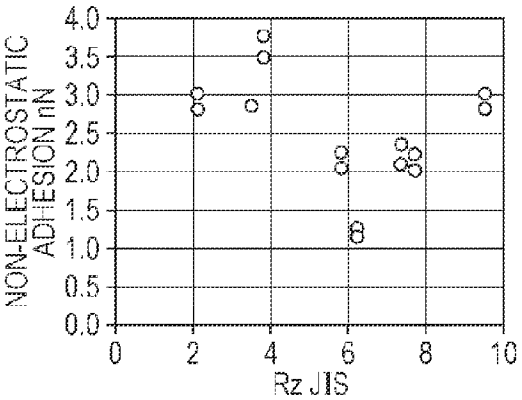
Figure 13C:
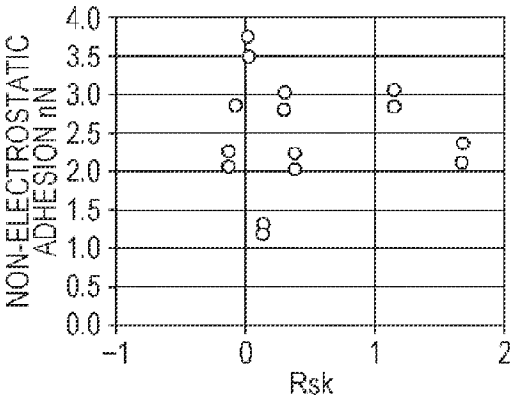
Figure 13D:
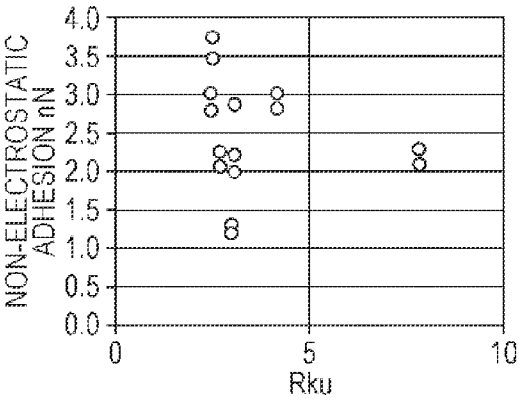

FIG. 11 is an explanatory view schematically illustrating toner behaviors in a developing device according to a second exemplary embodiment.

In the second exemplary embodiment, the basic configuration of the developing device 24 is substantially the same as in the first exemplary embodiment except for the composition of the toner TN.

In the second exemplary embodiment, the toner TN includes a binder resin, a colorant, and a release agent as in the first exemplary embodiment; however, unlike the first exemplary embodiment, the toner TN further includes an external additive W having a small particle diameter of less than 30 nm only.

The toner TN of the second exemplary embodiment will be described in detail in Example 7 below.

Toner behaviors in the developing device 24 according to the second exemplary embodiment will be described.

As in the first exemplary embodiment, the case of using a new toner (toner at the initial stage of usage) and the case of using an aged toner (toner having been used over time) will be schematically individually described.

New Toner

In the exemplary embodiment, the toner TN is a low-temperature fixing toner and contains, in addition to a binder resin, a colorant, and a release agent, as an example of an additive, an external additive W having a small particle diameter β of less than 30 nm only.

At the initial stage of usage, the external additive W is substantially uniformly distributed over the entire particle surfaces of the toner TN. Accordingly, as illustrated in FIG. 11, when the toner TN is passed under the charging blade 45, the toner TN held on the development roller 41 is sufficiently frictionally charged with the charging blade 45. When the toner TN having been sufficiently frictionally charged reaches the development region m, which is under the developing electric field E based on the development voltage Vdev applied by the development power source 51, the toner TN is caused to fly toward the photoconductor 21 and adheres to an electrostatic latent image formed on the photoconductor 21 to thereby visualize the electrostatic latent image.

Aged Toner

When the toner TN is used over time, for example, due to a mechanical stress applied by the charging blade 45, the external additive W may be separated from the particle surfaces of the toner TN or the small-particle-diameter external additive W may be substantially embedded in the particle surfaces of the toner TN. When this toner TN (mostly particles of the properly charged toner TNa) reaches the development region m, under the influence of the developing electric field E, the toner TN is caused to fly toward the photoconductor 21 to thereby develop an electrostatic latent image. As the toner TN ages, a portion of the toner TN may become the improperly charged toner TNb. However, because of the non-electrostatic adhesion described below, the improperly charged toner TNb is not used for development and is held on the development roller 41.

At this time, the improperly charged toner TNb adheres to the surface of the development roller 41 at a non-electrostatic adhesion (2 nN or more) that is probably similar to that of the properly charged toner TNa described below, under the predetermined environmental conditions (low temperature of 10° C. and low relative humidity of 15%). The non-electrostatic adhesion suppresses flying of the improperly charged toner TNb. On the other hand, although the properly charged toner TNa is also under the non-electrostatic adhesion, the electrostatic force of the developing electric field E sufficiently acts on the charge of the properly charged toner TNa, the properly charged toner TNa is used to develop an electrostatic latent image in the development region m.

As described in Examples below, the non-electrostatic adhesion is measured in terms of the properly charged toner TNa and is not directly measured in terms of the improperly charged toner TNb. However, the properly charged toner TNa and the improperly charged toner TNb are both in the aged state whether they are properly or improperly charged; accordingly, the improperly charged toner TNb adheres to the surface of the development roller 41 at a non-electrostatic adhesion that is probably similar to that of the properly charged toner TNa.

EXAMPLES

Example 1

A developing device according to the first exemplary embodiment is used in Example 1. The reason why attention has been focused on the oil retention volume as an index representing the surface roughness of a development roller used in Example 1 will be described.

Regarding factors that cause the non-electrostatic adhesion of the toner adhesion to a development roller, attention is focused on indices relating to the surface roughness of the development roller. Regarding the indices, the surface roughness of target surfaces of plural development roller models is measured with a SURFCOM 1400D (manufactured by TOKYO SEIMITSU CO., LTD.) serving as a surface roughness measuring instrument and the non-electrostatic adhesion of the toner adhesion to each development roller model is calculated.

The selected indices relating to the surface roughness of the development roller models are listed below. These indices are based on JIS B0601:'01.

(1) oil retention volume V0
(2) oil retention depth Rvk
(3) mean slope RΔa
(4) developed length ratio Rlr
(5) arithmetical mean roughness Ra
(6) ten point height of roughness profile RzJIS
(7) amplitude skewness Rsk
(8) amplitude kurtosis Rku
(9) initial wear height Rpk
(10) initial wear length Mr1
(11) oil retention length Mr2
(12) width of profile elements Sm The results are described in FIGS. 12A to 14D.

Figure 14A:
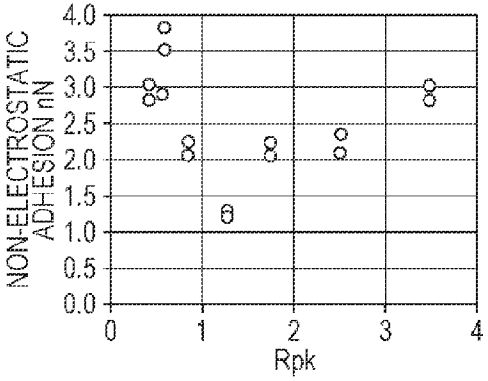
FIGS. 14A to 14C are graphs for the above-described evaluation, the graphs illustrating the relationships between the non-electrostatic adhesion and indices (parameters) relating to lubricity of the surface roughness of a development roller (initial wear height Rpk, initial wear length Mr1, and oil retention length Mr2)
Figure 14B:
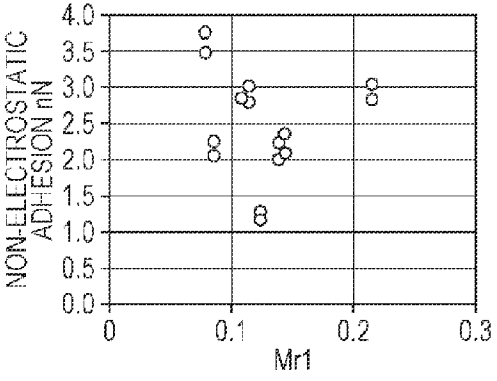
Figure 14C:
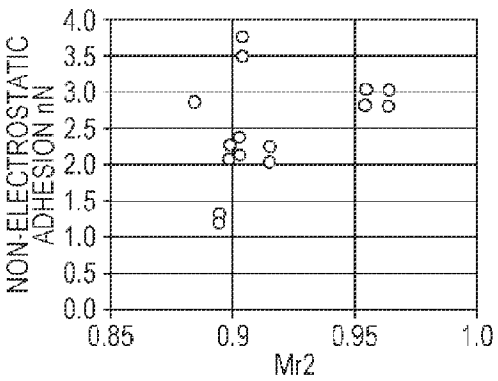
Figure 14D:
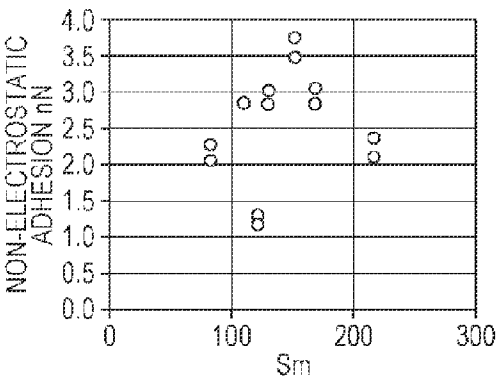
FIG. 14D is a graph for the above-described evaluation, the graph illustrating the relationship between the non-electrostatic adhesion and an index (parameter) relating to the lateral direction of the surface roughness of a development roller (width of profile elements Sm)

FIGS. 12A to 12D are graphs illustrating the relationships between the toner non-electrostatic adhesion and indices relating to smoothness of surface roughness, that is, (1) oil retention volume V0 to (4) developed length ratio Rlr. FIGS. 13A to 13D are graphs illustrating the relationships between the toner non-electrostatic adhesion and indices relating to height of surface roughness, that is, (5) arithmetical mean roughness Ra to (8) amplitude kurtosis Rku. FIGS. 14A to 14C are graphs illustrating the relationships between the toner non-electrostatic adhesion and indices relating to lubricity of surface roughness, that is, (9) initial wear height Rpk to (11) oil retention length Mr2. FIG. 14D is a graph illustrating the relationship between the toner non-electrostatic adhesion and an index relating to the lateral direction of surface roughness, that is, (12) width of profile elements Sm.

The results in FIGS. 12A to 12D indicate that the non-electrostatic adhesion has strong correlations with the indices relating to smoothness of surface roughness, and has the strongest correlation with the oil retention volume V0. The degree of correlation is evaluated in the following manner. In each graph, an approximate line is determined from plots by the method of least squares. On the basis of deviations between the approximate line and plots, the degree of correlation is evaluated.

On the other hand, the results in FIGS. 13A to 14D indicate that the non-electrostatic adhesion does not have correlations with the indices relating to height, lubricity, or the lateral direction.

Figure 15:
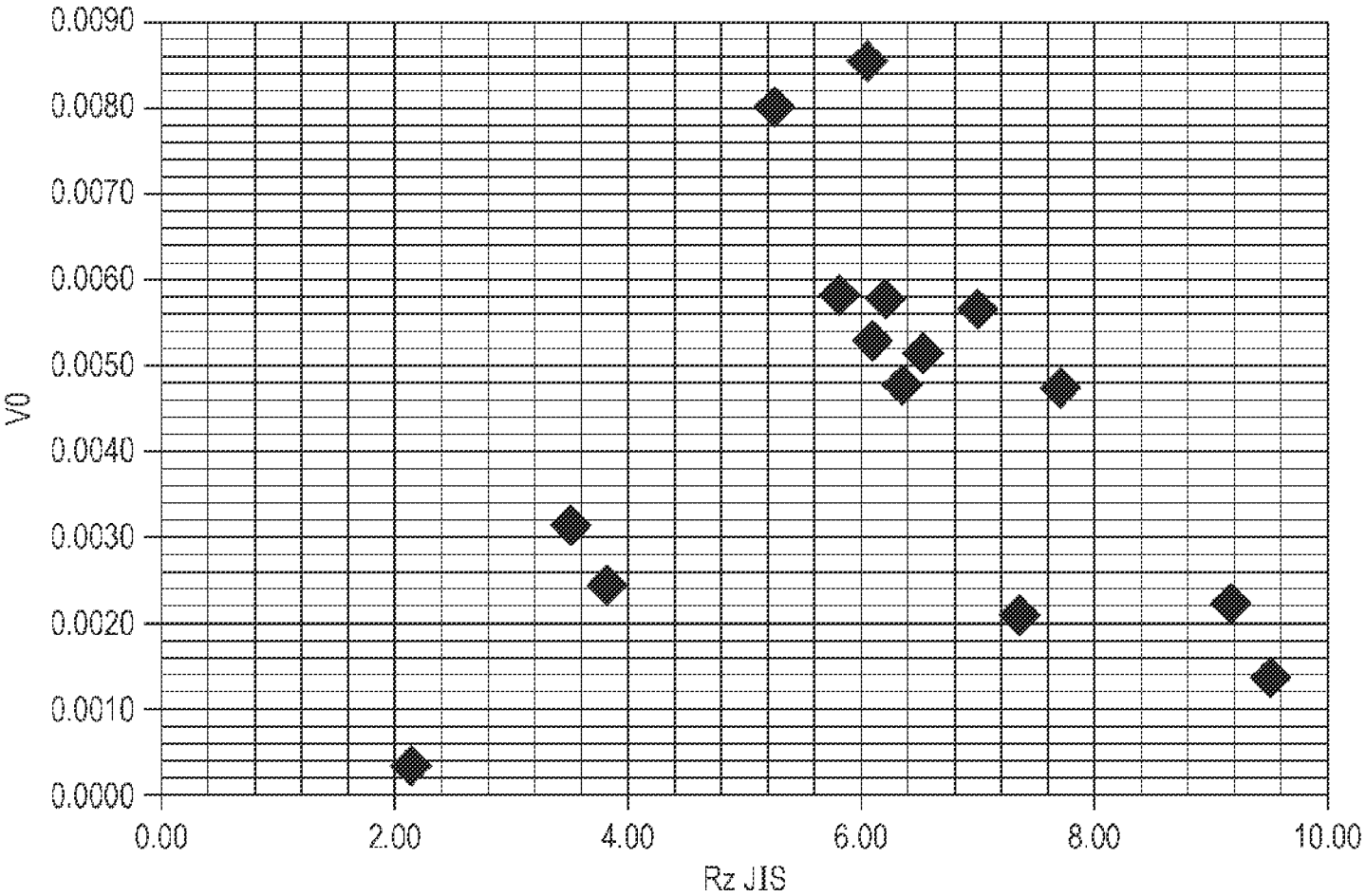
FIG. 15 is a graph illustrating the relationship between the oil retention volume V0 and the ten point height of roughness profile RzJIS that are indices of the surface roughness of a development roller.

The relationship between the oil retention volume V0 and the ten point height of roughness profile RzJIS is examined and the results illustrated in FIG. 15 are obtained. Thus, no correlation is found between these indices. In addition, relationships between the oil retention volume V0 and other indices relating to height, lubricity, or profile elements are also examined. Similarly, no correlation is found.

Figure 17:
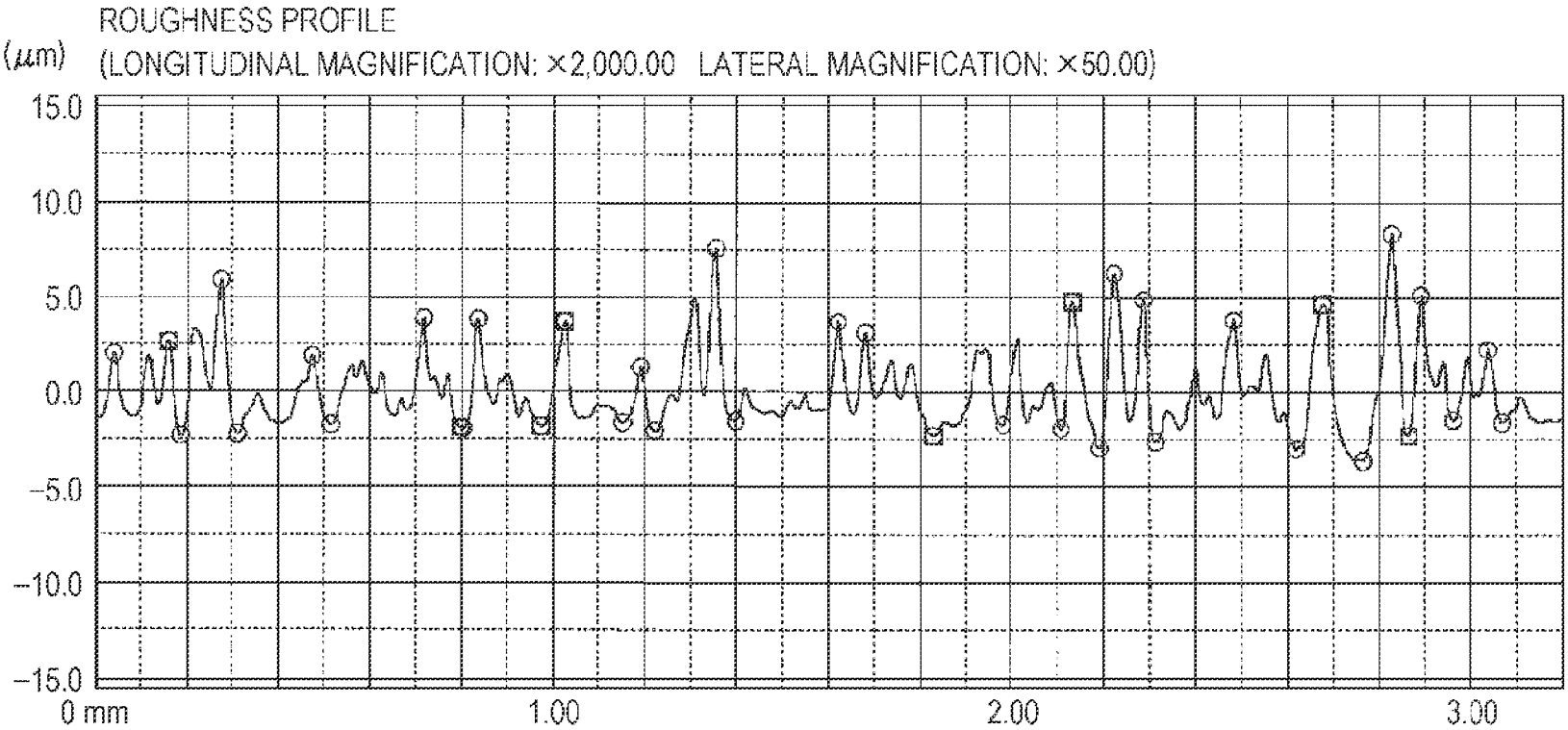
FIG. 17 is an explanatory view illustrating a roughness profile of a target surface of the measurement example in FIG. 16.

FIG. 16 describes measurement conditions of a SURFCOM 1400D (manufactured by TOKYO SEIMITSU CO., LTD.) serving as a surface roughness measuring instrument, and a measurement example for a surface roughness profile illustrated in FIG. 17 in terms of indices.

In view of the above-described results, in the exemplary embodiment, attention has been focused on the oil retention volume V0 among indices relating to the surface roughness of a development roller, as a factor that causes the non-electrostatic adhesion of the toner adhesion.

Example 2

A developing device according to the first exemplary embodiment is used in Example 2. An example of a method for evaluating the toner adhesion to a development roller used in Example 2 will be described.

Measurement with Particle Charge Amount Distribution Measurement System

An E-spart manufactured by Hosokawa Micron Corporation is used as a particle charge amount distribution measurement system. As illustrated in FIG. 18A, while the surface of a counter electrode (photoconductor) is charged to a potential of −202 V, the voltage applied to the development roller is varied (in this example, the voltage is composed of a direct current component Vdc only). Thus, developing electric fields are formed between the development roller and the photoconductor in accordance with development potential differences (development voltages) Vdev. For each developing electric field, the developed mass per area (DMA) is determined.

Figure 19:
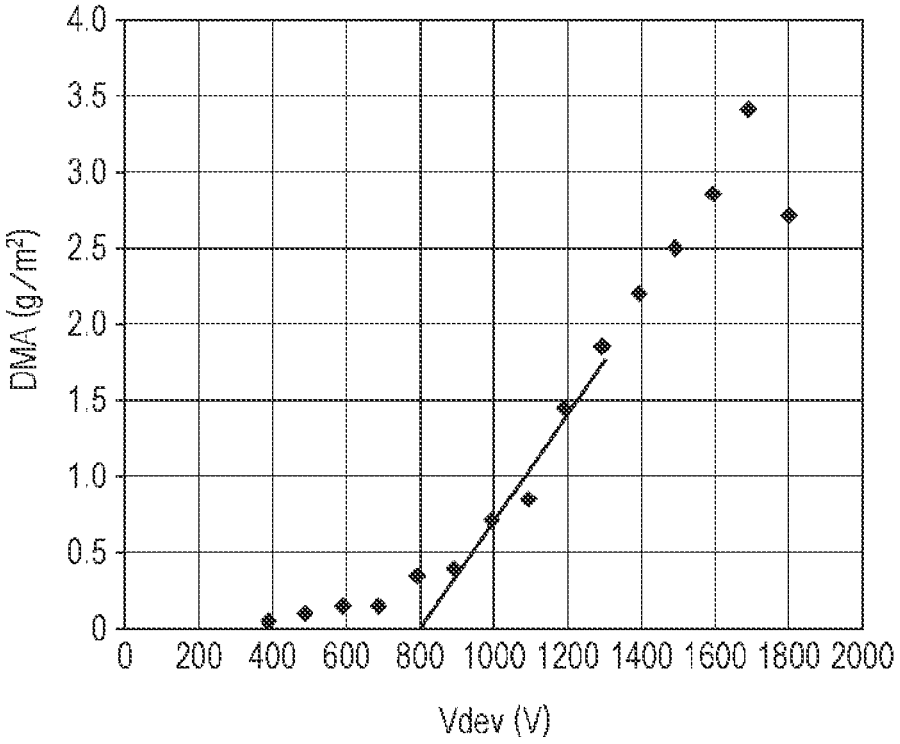
FIG. 19 is a graph illustrating the relationship between the development voltage Vdev and the developed mass per area (DMA) based on the data in FIG. 18A.

Referring to FIG. 19, a development curve representing the relationship between the development voltage Vdev and the developed mass per area (DMA) is drawn.

FIG. 19 indicates that, when Vdev is equal to or more than a value, DMA substantially increases in proportion to Vdev. The approximate line in FIG. 19 is obtained by the method of least squares in terms of shaded Vdev data in FIG. 18A.

Among the conditions in FIG. 18A, some conditions (four in this example) are selected for measurements in terms of charge amount Q and particle diameter d of toner particles having flown to the counter electrode. Regarding these conditions, the charge amount Q (fC) and the particle diameter d (μm) are measured. The results are described in FIG. 18B.

The measurement conditions for the measurement of Q and d may be appropriately selected. In this example, regarding the measurement conditions, in order to measure the adhesion of a toner having been used over time, the developing device is idled until the number of printing for a standard size sheet (in this example, A4-size printing in the lateral direction) virtually reaches 15 kPV; and the measurement values are determined as averages in terms of 3000 toner particles that are measured.

In FIG. 18B, DRS represents the space between the drum-shaped photoconductor and the development roller. The total adhesion (toner adhesion) of toner particles having flown to the counter electrode (photoconductor) due to the developing electric field under the development conditions is about −5 to about −6 (nN) on average. The total adhesion F is calculated by F=Q×Vdev/DRS.

Figure 20A:
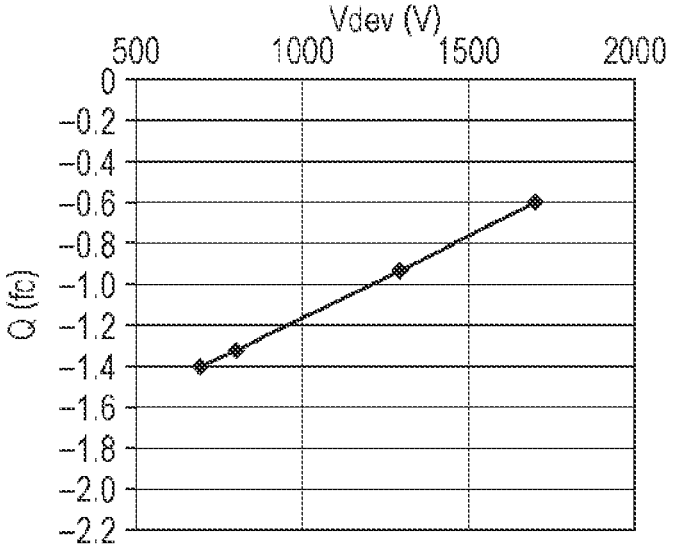
FIG. 20A is a graph illustrating the relationship between the development voltage Vdev and the charge amount of a development toner based on the data in FIG. 18B.
Figure 20B:
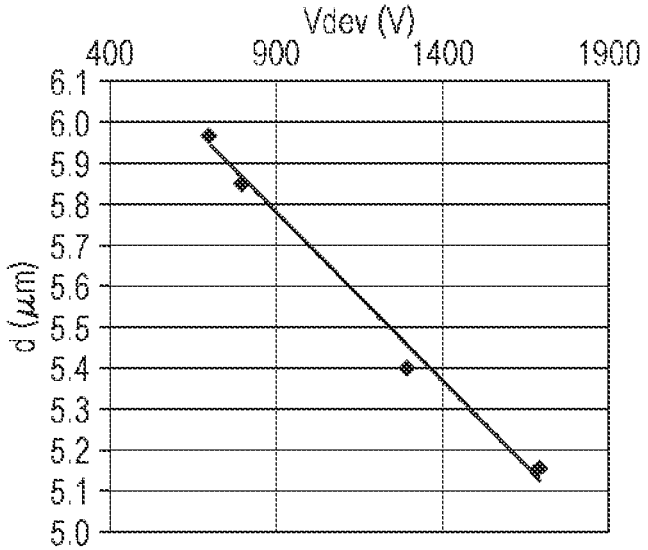
FIG. 20B is a graph illustrating the relationship between the development voltage Vdev and the particle diameter of a development toner based on the data in FIG. 18B.

On the basis of the results in FIG. 18B, the Vdev-Q relationship is plotted to provide the graph in FIG. 20A; and the Vdev-d relationship is plotted to provide the graph in FIG. 20B. In each graph, the approximate line is determined from the plots by the method of least squares.

FIG. 20A indicates that Q substantially increases in proportion to an increase in Vdev. FIG. 20B indicates that d substantially decreases in proportion to an increase in Vdev.

In the approximate line representing the Vdev-DMA relationship in FIG. 19, a value of Vdev at DMA=0 probably corresponds to a development voltage Vdev at which toner particles start to fly. This value of Vdev (toner flying start development voltage Vdev) is determined and the result is described in FIG. 18C.

In the Vdev-Q approximate line in FIG. 20A, a value of Q at the toner flying start development voltage Vdev is determined as a charge amount at which the toner particles start to fly. In the Vdev-d approximate line in FIG. 20B, a value of d at the toner flying start development voltage Vdev is determined as a toner particle diameter d at which the toner particles start to fly. The results are described in FIG. 18C.

Thus, the values of development voltage Vdev, charge amount Q, and toner particle diameter d (corresponding to average particle diameter) at which the toner particles start to fly to the development roller as a measurement target are determined. From these values, by using the arithmetic expression F=Q×Vdev/DRS, the value of total adhesion F of toner particles that start to fly is calculated.

Evaluation of Toner Adhesion

In evaluation of toner adhesion, a first case of using a charging blade, for example, an aged blade formed of phosphor bronze is considered. The above-described measurements with a particle charge amount distribution measurement system are performed and the flying start development voltage Vdev, the toner flying start charge amount Q, and the toner flying start particle diameter d described in FIG. 21 are assumed to be determined.

On the other hand, a second case of using a charging blade under the same conditions as in the above-described case except for the charge amount, for example, a new blade formed of phosphor bronze, is considered. The above-described measurements with a particle charge amount distribution measurement system are similarly performed and the flying start development voltage Vdev, the toner flying start charge amount Q, and the toner flying start particle diameter d described in FIG. 21 are determined under the conditions.

Figure 22:
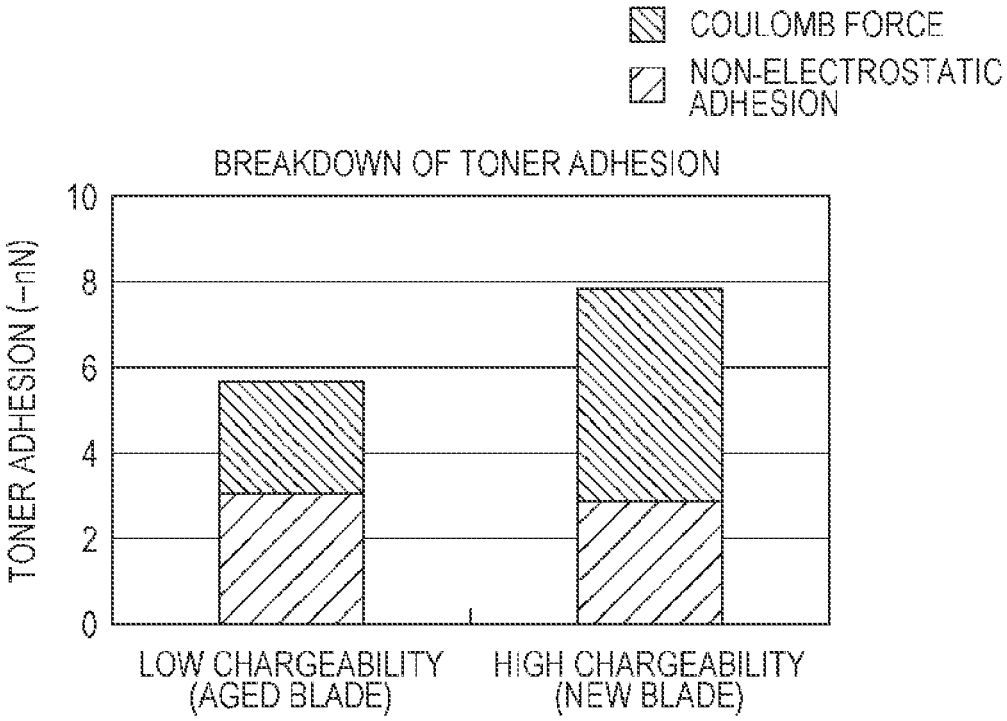
FIG. 22 is an explanatory view schematically illustrating the process of breaking down adhesion on the basis of the adhesion calculation sheet in FIG. 21.

Regarding these first and second cases, into the numerical formula for calculating the toner adhesion F in FIG. 7A, Q1 and d1 under the first measurement conditions and Q2 and d2 under the second measurement conditions are assigned to form simultaneous equations in FIG. 22. F(1) denotes the toner adhesion under the first measurement conditions. F(2) denotes the toner adhesion under the second measurement conditions. These measurements are performed under the predetermined low-temperature low-humidity environment (temperature: 10° C., relative humidity: 15%).

The simultaneous equations are solved with the coefficients A and B serving as two unknowns. Thus, the coefficients A and B are calculated as described in FIG. 21.

As a result, the coefficients A and B of the numerical formula in FIG. 7A are determined (refer to FIG. 21). Thus, the numerical formula of toner adhesion F is determined. In this numerical formula, a Coulomb force (electrostatic adhesion) is calculated from the first term and a non-electrostatic adhesion is calculated from the second term. The results are described in FIGS. 21 and 22. On the basis of the results, in FIG. 22, the breakdown of the toner adhesion composed of the Coulomb force and the non-electrostatic adhesion is illustrated in the graph.

From this graph, when the charging blade having high chargeability (new blade) is used, the total toner adhesion (toner adhesion) is high and the Coulomb force is also high, compared with the case where the charging blade having low chargeability (aged blade) is used.

Unlike the Coulomb force, the non-electrostatic adhesion is substantially the same value of 2 nN or more under the low-temperature low-humidity environment (temperature: 10° C., relative humidity: 15%) for the charging blade having high chargeability and the charging blade having low chargeability.

Example 3

A developing device according to the first exemplary embodiment is used in Example 3. The relationship between toner adhesion and fogging concentration on a photoconductor (corresponding to stains due to flying of improperly charged toner) is evaluated.

Relationship Between Toner Adhesion and Fogging Concentration of Toner Transferred onto Photoconductor A charging blade having high chargeability (new blade) and a charging blade having low chargeability (aged blade) are used; for example, plural development roller models (models different in oil retention volume V0 serving as a surface roughness index) are used to vary total toner adhesion (toner adhesion); at this time, the fogging concentrations of toner having been transferred onto a photoconductor are measured. The results are described in FIG. 23.

Figure 23:
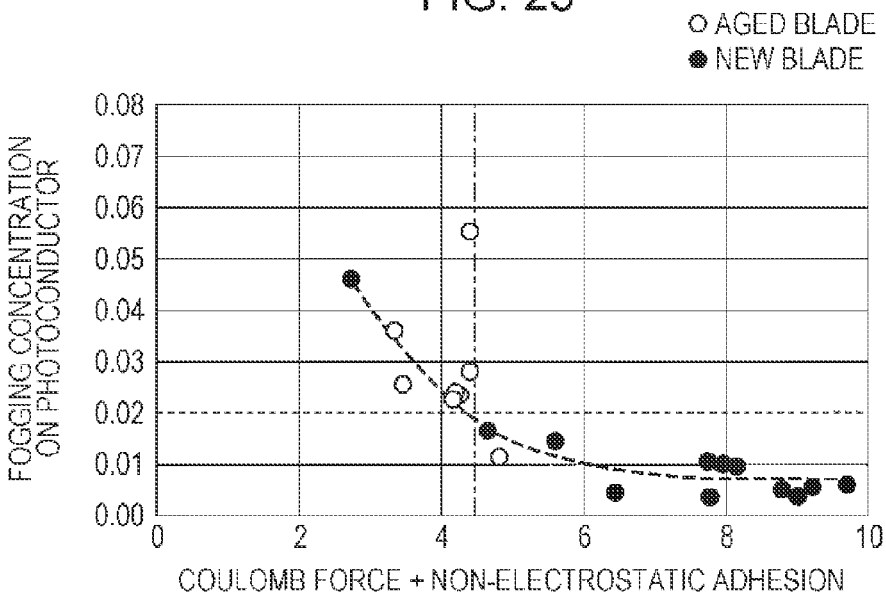
FIG. 23 is a graph illustrating the relationship between toner adhesion and fogging concentration on a photoconductor in a developing device in Example 3.

FIG. 23 indicates that, when the allowable value of the fogging concentration of toner on a photoconductor is defined as 0.02 or less, the corresponding value of the total toner adhesion (toner adhesion) is 4.5 nN or more under the low-temperature low-humidity environment (temperature: 10° C., relative humidity: 15%).

In this example, since toner fogging on a photoconductor correlates with mass on developer roll (MD), in order to cancel out variations among experiments due to MD, the fogging concentration is calculated with a formula "fogging concentration (converted value)=fogging concentration (measurement value)×(3 $g/m^2$)/(MD $g/m^2$ used in experiment)". The fogging concentration is measured in the following manner. The fogging toner on a photoconductor is transferred onto a substantially transparent tape. This tape is attached to a predetermined sheet and the concentration of fogging toner on the sheet is measured with an X-Rite983nite. Another substantially transparent tape to which toner is not transferred is attached to the above-described sheet and the concentration is similarly measured as a reference concentration. This reference concentration is subtracted from the measured concentration to provide the fogging concentration on the photoconductor.

In the above-described example models, instead of the total toner adhesion (toner adhesion), Coulomb force is used as the parameter to measure the fogging concentration of toner having been transferred onto a photoconductor. The results are described in FIG. 24.

Figure 24:
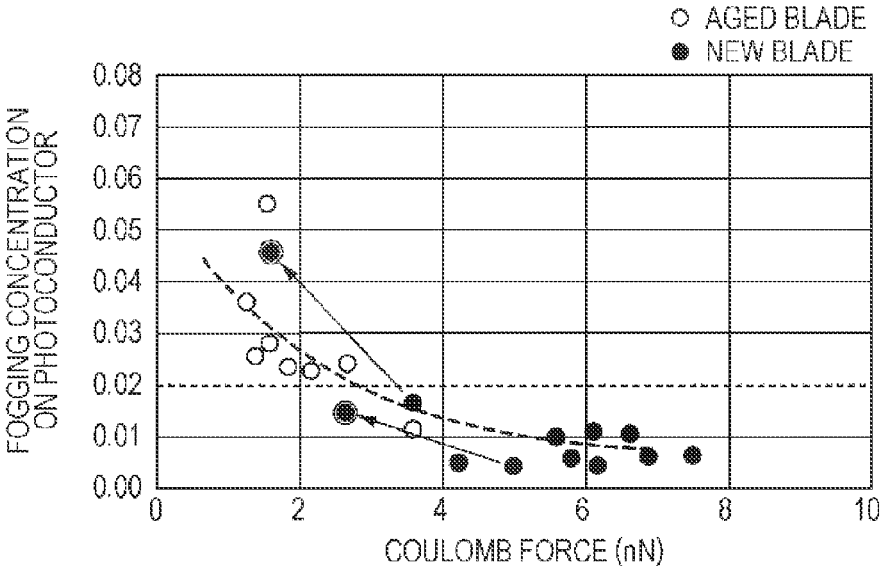
FIG. 24 is a graph illustrating the relationship between Coulomb force and fogging concentration on a photoconductor in a developing device in Example 3.

FIG. 24 indicates that, for example, when the charging blade is aged, the Coulomb force of the toner decreases by about 2 to about 2.4 nN as illustrated by the arrows. That is, in the total toner adhesion (toner adhesion), the Coulomb force is influenced by the chargeability of a charging blade and tends to vary.

On the other hand, in the above-described example models, instead of the total toner adhesion (toner adhesion), the non-electrostatic adhesion is used as the parameter to measure the fogging concentration of toner having been transferred onto a photoconductor. The results are described in FIG. 25.

Figure 25:
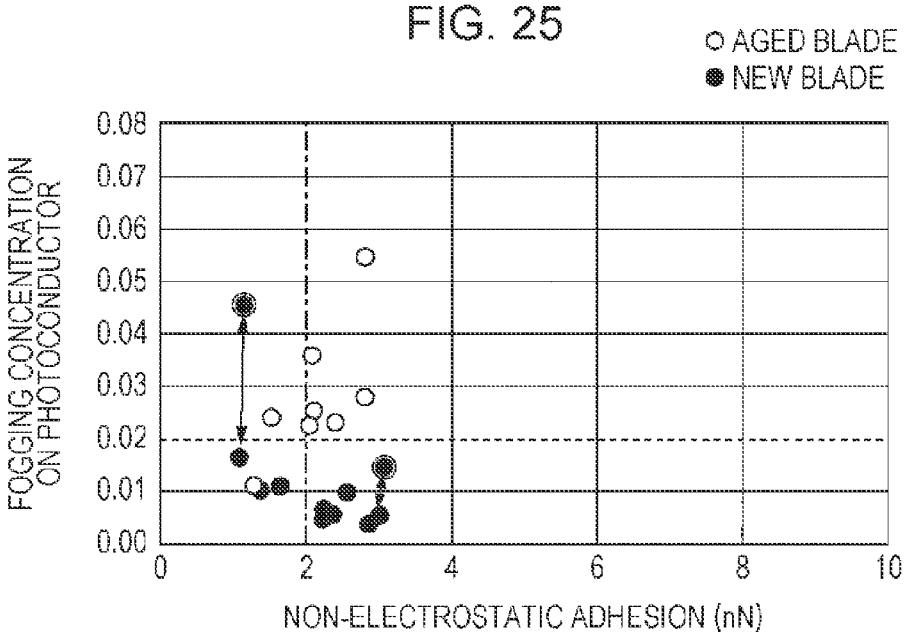
FIG. 25 is a graph illustrating the relationship between non-electrostatic adhesion and fogging concentration on a photoconductor in a developing device in Example 3.

FIG. 25 indicates that, for example, when the charging blade is aged, the fogging concentration of toner varies accordingly; however, the non-electrostatic adhesion substantially remains the same as illustrated by the arrows and the non-electrostatic adhesion is less likely to be influenced by aging of a charging blade due to usage over time. Thus, even when the chargeability of a charging blade varies, the non-electrostatic adhesion substantially remains the same. For this reason, by adjusting the surface roughness of the development roller such that the non-electrostatic adhesion becomes a relatively large value, the total toner adhesion (toner adhesion) is increased to a certain level.

From FIG. 25, regarding the cases of using the charging blade having high chargeability (new blade), the relationship between the non-electrostatic adhesion and the fogging concentration of toner having been transferred onto a photoconductor is extracted. The result is illustrated in FIG. 26.

Figure 26:
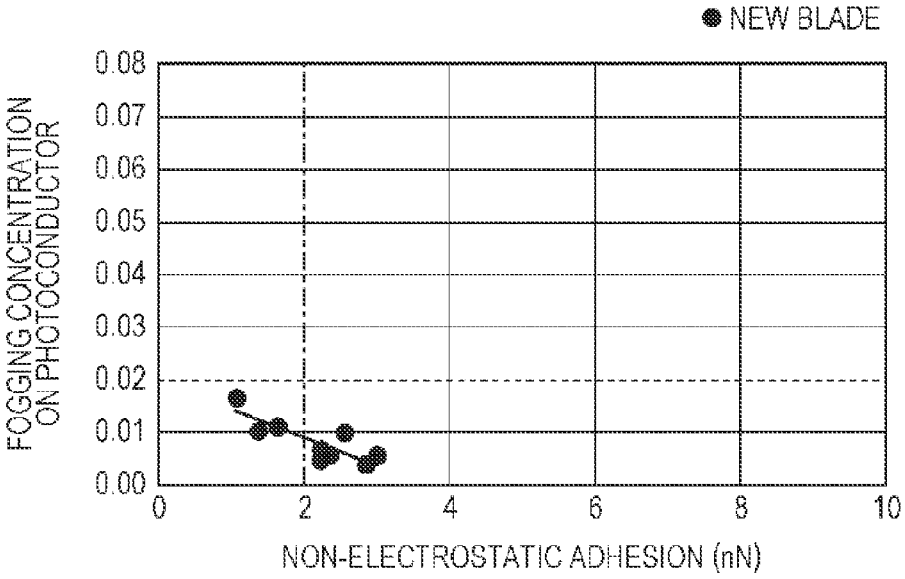
FIG. 26 is a graph illustrating the relationship between non-electrostatic adhesion and fogging concentration on a photoconductor, regarding the cases where the toner is charged with a charging blade having high chargeability, in a developing device in Example 3.

In FIG. 26, in all the plots, the toner fogging concentration is within the allowable range. In these plots, since the charging blade having high chargeability is used, the Coulomb force becomes a relatively high value of 2.5 nN or more. Thus, under such conditions, the non-electrostatic adhesion suppresses the toner fogging phenomenon.

In FIG. 26, the toner fogging concentration tends to decrease in proportion to an increase in the non-electrostatic adhesion, which is indicated by the approximate line obtained from the plots by the method of least squares.

Thus, when the non-electrostatic adhesion is 2 nN or more, the toner fogging concentration is suppressed to 0.01 or less.

Example 4

A developing device according to the first exemplary embodiment is used in Example 4. Desired characteristics of a development roller used in Example 4 will be examined.

Figure 27:
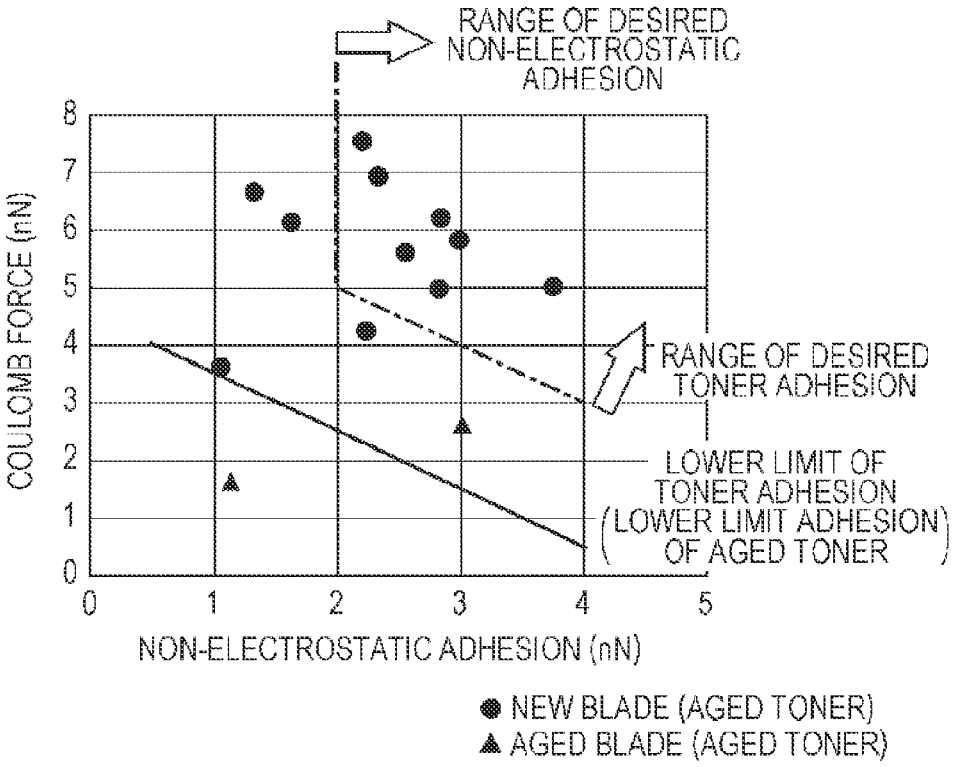
FIG. 27 is an explanatory view illustrating characteristics of a development roller used in a developing device in Example 4.

In this example, an aged toner is used that is obtained by idling the device until the number of printing for a standard size sheet (in this example, A4-size printing in the lateral direction) virtually reaches 15 kPV; a charging blade having high chargeability (new blade) and a charging blade having low chargeability (aged blade) are used; the relationship between the Coulomb force and the non-electrostatic adhesion of the toner adhesion is examined. The results are illustrated in FIG. 27. All these adhesion values are measured in the low-temperature low-humidity environment (temperature: 10° C., relative humidity: 15%).

In FIG. 27, the lower limit of the total toner adhesion (toner adhesion) is represented by the solid line (4.5 nN). The range of a desired toner adhesion is represented by a region above a single dot-dashed line (7.0 nN).

The range of a desired non-electrostatic adhesion, which is less influenced by aging of a charging blade, is a region of 2 nN or more as indicated by another single dot-dashed line in FIG. 27.

Figure 28:
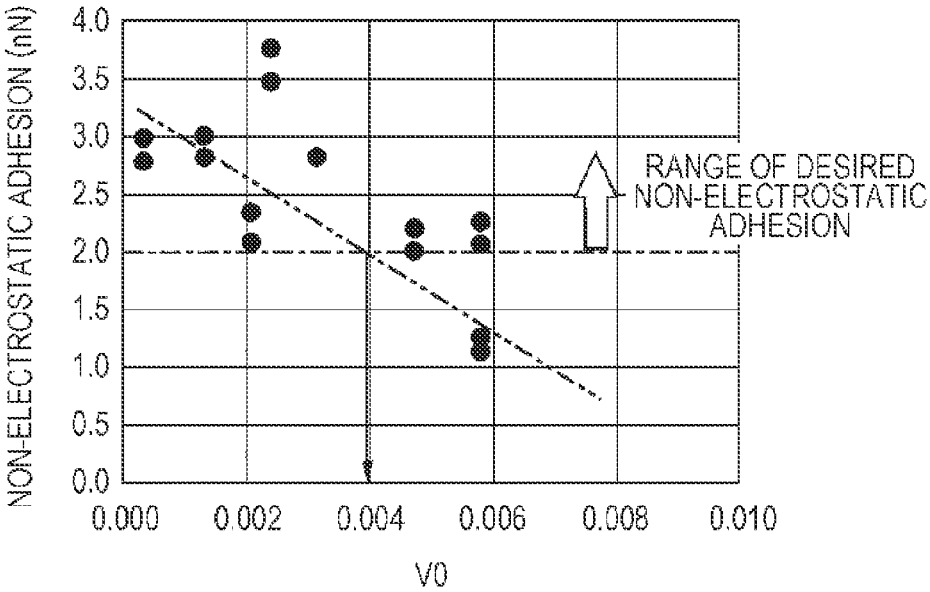
FIG. 28 is an explanatory view illustrating the relationship between V0 and non-electrostatic adhesion measured with a measurement system in terms of the development roller in FIG. 27.

The relationship between non-electrostatic adhesion and oil retention volume V0 serving as an index of the surface roughness of a development roller is illustrated in FIG. 28.

In FIG. 28, an approximate line determined from plots by the method of least squares is illustrated as the double dot-dashed line. At the point of intersection between the approximate line and the threshold value (2.0 nN) of the range of a desired non-electrostatic adhesion, the value of V0 is 0.004. Thus, in the range of a desired non-electrostatic adhesion, the oil retention volume V0 is 0.004 or less.

In this example, an aged toner is used that is obtained by idling the device until the number of printing for a standard size sheet (in this example, A4-size printing in the lateral direction) virtually reaches 15 kPV; a charging blade having high chargeability (new blade) and a charging blade having low chargeability (aged blade) are used; the relationship between the Coulomb force of the toner adhesion and the toner flying start charge amount is examined. The results are illustrated in FIG. 29.

Figure 29:
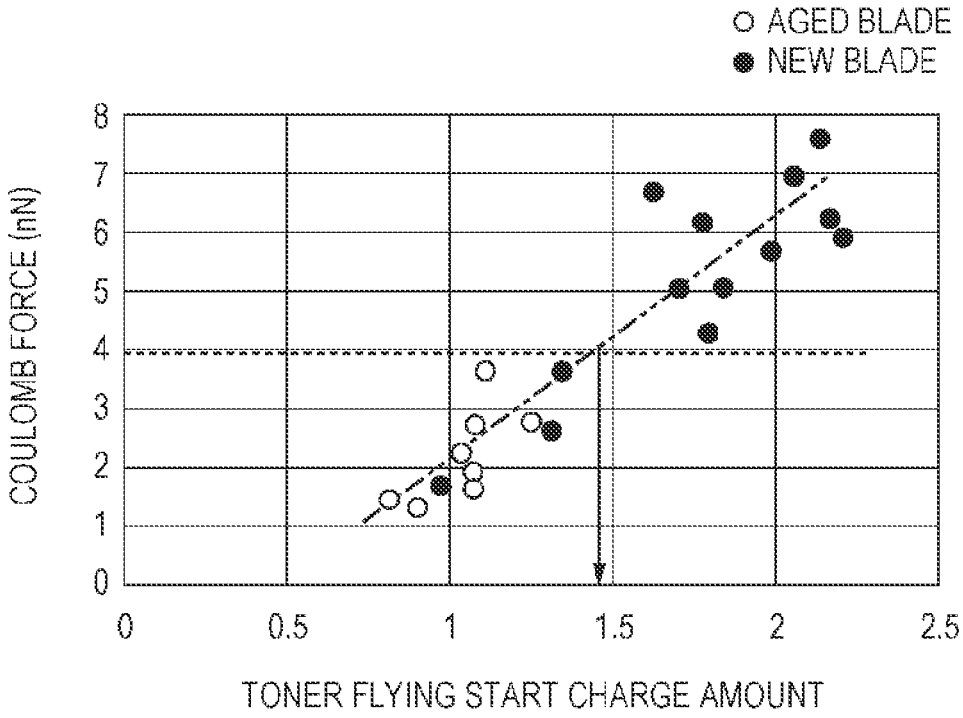
FIG. 29 is a graph illustrating the relationship between toner flying start charge amount and Coulomb force in terms of the development roller in FIG. 27.

In FIG. 29, the Coulomb force is substantially in proportion to the toner flying start charge amount and an approximate line thereof is determined. In the case where the total toner adhesion (toner adhesion) is 7.0 nN or more and the non-electrostatic adhesion is 2.0 to 3.0 nN, for example, 3.0 nN, the corresponding Coulomb force is 4.0 nN or more. Thus, the corresponding value of the toner flying start charge amount is about 1.5 fC or more.

Example 5

A developing device according to the first exemplary embodiment is used in Example 5. Regarding development rollers used in Example 5, the relationship between the toner non-electrostatic adhesion and the toner flying start particle diameter is examined. For reference, development rollers not within the scope of Example 5 are similarly examined as Comparative example 5.

Relationship Between Non-Electrostatic Adhesion and Toner Flying Start Particle Diameter As described in FIG. 30, plural development roller models are prepared. By varying the chargeability of a charging blade for each development roller model, the toner adhesion, Coulomb force, and non-electrostatic adhesion at which toner particles start to fly are determined; in addition, in each case, the particle diameter at which toner particles start to fly is determined.

Figure 31:
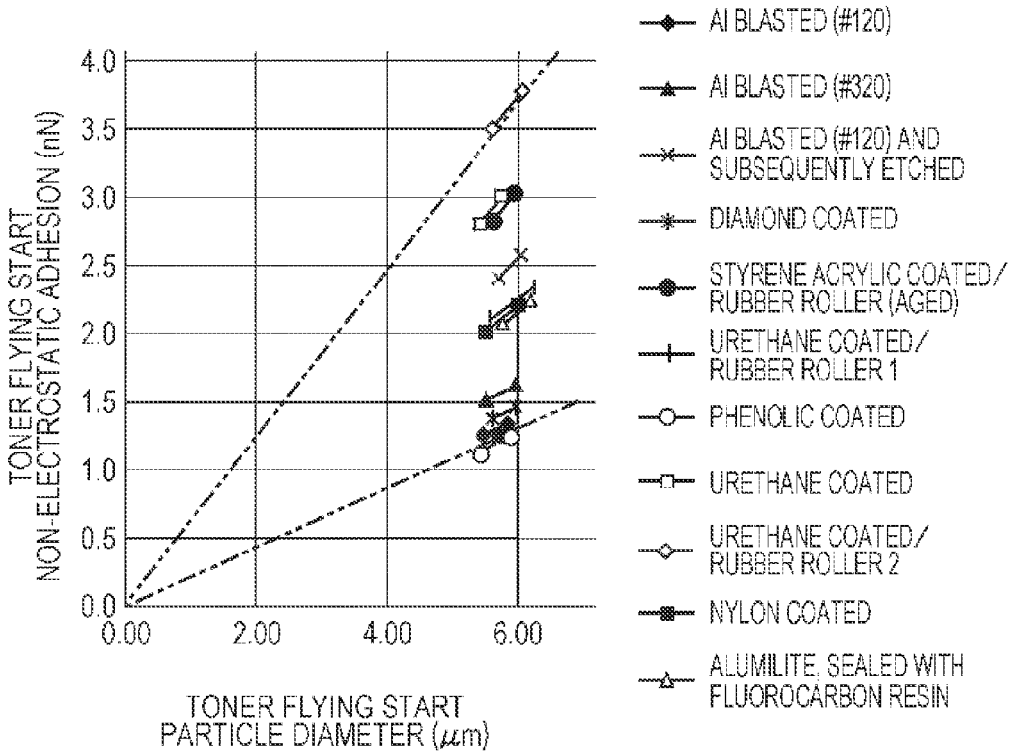
FIG. 31 is a graph illustrating the relationship between toner flying start particle diameter and toner flying start non-electrostatic adhesion on the basis of data in FIG. 30.

The results are illustrated in FIG. 31.

In FIG. 31, the toner flying start particle diameter is substantially proportional to the toner flying start non-electrostatic adhesion.

Example 6

Figure 32:
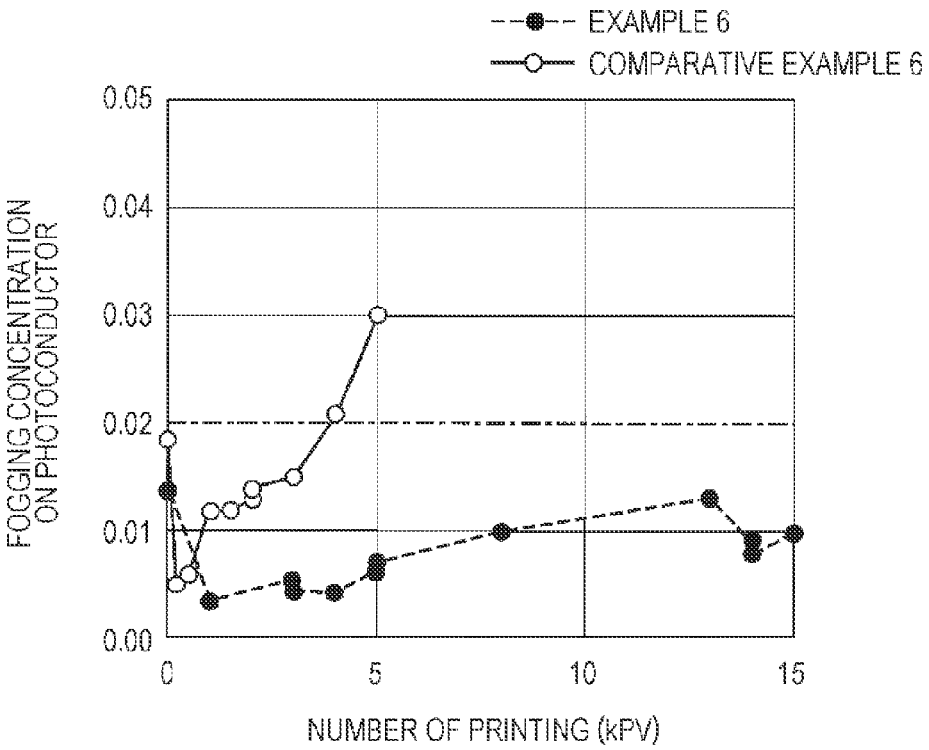
FIG. 32 is a graph illustrating changes in the fogging concentration on a photoconductor over time in a developing device in Example 6 and a developing device in Comparative Example 6.

A developing device according to the first exemplary embodiment is used in Example 6. The developing device in Example 6 is used over time by being idled until the number of printing for a standard size sheet (in this example, A4-size printing in the lateral direction) virtually reaches 15 kPV. During this idling, the fogging concentration of toner having been transferred onto a photoconductor is measured. As a result, as illustrated in FIG. 32, the fogging concentration is within the allowable range (in this example, 0.02 or less in terms of TMDA).

For comparison, a case where a development roller (for example, aluminum rough surface) does not satisfy the numerical formula of the oil retention volume V0 serving as an index of surface roughness in the first exemplary embodiment is defined as Comparative example 6. This Comparative example 6 is evaluated under the same conditions as in Example 6. As a result, as illustrated in FIG. 32, after the number of printing exceeds about 4 kPV, the fogging concentration of toner having been transferred onto a photoconductor does not satisfy the allowable level.

Example 7

A developing device according to the second exemplary embodiment will be described in Example 7. A toner prepared in the following manner is used.

Preparation of Toner

Preparation of Rutile-Type Titanium Oxide External Additive

To a solvent mixture of methanol-water (95:5) in which 1.0 part of methyltrimethoxysilane is dissolved, 10 parts of a rutile-type titanium oxide powder (MT-150A manufactured by Tayca Corporation) that has a volume-average particle diameter of 15 nm and has been washed with water to reduce the water-soluble component amount, is added and ultrasonically dispersed. Subsequently, methanol and the like in the dispersion are evaporated with an evaporator to dry the dispersion. This dried substance is then heat-treated in a dryer at 120° C. and pulverized with a mortar. Thus, a rutile-type titanium oxide external additive that has a volume-average particle diameter of 20 nm and a specific gravity of 4.1 and has been surface-treated with methyltrimethoxysilane is obtained.

Dry External Addition Step

A 5-liter Henschel mixer is charged with 100 parts of colorant particles, 0.60 parts of the rutile-type titanium oxide external additive, and 1.00 part of a small particle diameter silica external additive R8200 (HMDS treated, manufactured by NIPPON AEROSIL CO., LTD.). The charged materials are mixed at 2,200 rpm for 2.5 minutes and sifted through a 45 μm mesh to prepare a toner.

Embedding Property of External Additive

The toner at the initial stage of usage and the toner having been used over time (for example, 15 kPV) are examined in terms of the embedding property of the external additive.

The toner at the initial stage of usage has a BET surface area of 2.42. This BET surface area is measured with a BET surface area analyzer (SA3100, manufactured by Beckman Coulter, Inc.) by nitrogen purge process. Specifically, 1.0 g of the toner to be measured is precisely weighed and charged into a sample tube. This tube is then outgassed and subjected to a multipoint automatic measurement. The resultant value is defined as a BET surface area (unit: $m^2/g$).

Micrographs of the toner are taken at a magnification of 30,000 with a scanning electron microscope (FE-SEM S-4700, manufactured by Hitachi, Ltd.). The adhesion state of the external additive is observed. As a result, the external additive uniformly adheres and is not embedded.

On the other hand, the toner having been used over time has a BET surface area of 1.68. Observation with the SEM reveals that the external additive is substantially embedded.

As described above, in this example, an external additive having a medium or large particle diameter is not added to the toner. Accordingly, at the initial stage of usage and during usage over time, the phenomenon in which the external additive having a medium or large particle diameter is partially embedded in the particle surfaces of the toner and remains in the form of projections does not occur. Therefore, change in the toner adhesion is less likely to be caused and a desired non-electrostatic adhesion (2 nN or more under the low-temperature low-humidity environment) is achieved from the initial stage of usage.

In the exemplary embodiments, attention is focused on the "oil retention volume V0" serving as an index relating to smoothness of the surface roughness of a development roller of a developing device. In addition, other indices relating to smoothness in FIGS. 12B to 12D (oil retention depth Rvk, mean slope RΔa, and developed length ratio Rlr) have strong correlations with the non-electrostatic adhesion. Accordingly, by determining the correlations between these indices and the non-electrostatic adhesion, desired surface roughness conditions of a development roller are obtained. Specifically, as in the exemplary embodiments, by defining relative ratios of the indices relating to smoothness of the surface roughness of a development roller to the average toner particle diameter d, that is, "Rvk/d", "RΔa/d", and "Rlr/d", and by determining threshold values.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents

What is claimed is:

1. A development device including:

a toner holding member that faces but is not in contact with an image carrier carrying a latent image and that rotates while holding a nonmagnetic toner, a charging member that charges the toner held by the toner holding member, and a developing electric field forming unit that forms a developing electric field at least including a direct current component having a predetermined potential difference between the image carrier and the toner holding member to cause the charged toner to fly and adhere to the latent image on the image carrier to develop the latent image, wherein $V0/d<6.8*10^{-4}$ is satisfied where d(μm) represents an average particle diameter of the nonmagnetic toner, regarding surface roughness of the toner holding member. V0 represents an oil retention volume corresponding to a volume of oil retained for an oil retention depth Rvk relative to a surface area of 1 $cm^2$, wherein V0 is defined as V0=(100−Mr2)*Rvk/2000 (μm), Mr2 represents an oil retention length, wherein in the state that the developing electric field forming unit is applied such that a strength of the direct current component starts to the toner from the toner holding member to the e carrier, maintaining a non-electrostatic adhesion of the toner to the toner holding member to be about 2 nN or more under a low-temperature low-humidity environment of a temperature of 10° C. and a relative humidity of 15%.

2. The development device according to claim 1, wherein an alternating current component having a periodically varying potential is superimposed on the direct current component.

3. The development device according to claim 1, wherein the toner includes a binder resin, a colorant, and an external additive having a particle diameter of 30 nm or more, and wherein the external additive is partially embedded in particle surfaces of the toner.

4. The development device according to claim 2, wherein the toner includes a binder resin, a colorant, and an external additive having a particle diameter of 30 nm or more, and wherein the external additive is partially embedded in particle surfaces of the toner.

5. The development device according to claim 1, wherein the toner includes a binder resin, a colorant, and an external additive composed of only particles having a diameter of less than 30 nm and wherein the external additive s substantially embedded in particle surfaces of the toner.

6. The development method according to claim 2, wherein the toner includes a binder resin, a colorant, and an external additive composed of only particles having a diameter of less than 30 nm, and wherein the external additive is substantially embedded in particle surfaces of the toner.

7. A developing device comprising:

a toner holding member that faces but is not in contact with an image carrier carrying a latent image and that rotates while holding a nonmagnetic toner, a charging member that charges the toner held by the toner holding member, and a developing electric field forming unit that forms a developing electric field at least including a direct current component having a predetermined potential difference between the image carrier and the toner holding member to cause the charged toner to fly and adhere to the latent image on the image carrier to develop the latent image, wherein $V0/d<6.8\times10^{-4}$ is satisfied where d (μm) represents an average particle diameter of the nonmagnetic toner and, regarding surface roughness of the toner holding member, V0 represents an oil retention volume corresponding to a volume of oil retained for an oil retention depth Rvk relative to a surface area of 1 $cm^2$, wherein V0 is defined as V0=(100)−Mr2)*Rvk/2000 (μm), Mr2 represents an oil retention length.

8. The developing device according to claim 7, wherein the developing electric field forming unit forms the developing electric field in which an alternating current component having a periodically varying potential is superimposed on the direct current component.

9. The developing device according to claim 7, wherein the toner holding member is a member formed by covering a surface of a metal base member with a resin cover layer, and the charging member is a metal plate member that is in contact with a surface of the toner holding member.

10. The developing device according to claim 8, wherein the toner holding member is a member formed by covering a surface of a metal base member with a resin cover layer, and the charging member is a metal plate member that is in contact with a surface of the toner holding member.

11. The developing device according to claim 7, wherein the toner has an average particle diameter of 6.5 μm or less.

12. The developing device according to claim 8, wherein the toner has an average particle diameter of 6.5 μm or less.

13. The developing device according to claim 9, wherein the toner has an average particle diameter of 6.5 μm or less.

14. The developing device according to claim 10, wherein the toner has an average particle diameter of 6.5 μm or less.

15. The developing device according to claim 11, wherein the toner contains, as a main component, a polyester resin serving as a binder resin.

16. The developing device according to claim 12, wherein the toner contains, as a main component, a polyester resin serving as a binder resin.

17. The developing device according to claim 11, wherein the toner contains a crystalline polyester resin serving as a binder resin.

18. The developing device according to claim 12, wherein the toner contains a crystalline polyester resin serving as a binder resin.

19. An image forming assembly that is detachably mountable to a receiving portion provided in a housing of an image forming apparatus, the image forming assembly comprising:

an image carrier that carries a latent image; and the developing device according to claim 7 that develops the latent image carried by the image carrier with a nonmagnetic toner.

20. An image forming apparatus comprising:

an image carrier that carries a latent image; and the developing device according to claim 7 that develops the latent image carried by the image carrier with a nonmagnetic toner.

* * * * *